US012628872B2

(12) United States Patent
Reevell

(10) Patent No.: US 12,628,872 B2
(45) Date of Patent: May 19, 2026

(54) AEROSOL GENERATION DEVICE AND HEATING CHAMBER THEREFOR

(71) Applicant: JT International SA, Geneva (CH)

(72) Inventor: Tony Reevell, London (GB)

(73) Assignee: JT International SA, Geneva (CH)

( * ) Notice: Subject to any disclaimer, the term of this patent is extended or adjusted under 35 U.S.C. 154(b) by 923 days.

(21) Appl. No.: 17/640,512

(22) PCT Filed: Sep. 4, 2020

(86) PCT No.: PCT/EP2020/074850
§ 371 (c)(1),
(2) Date: Mar. 4, 2022

(87) PCT Pub. No.: WO2021/044023
PCT Pub. Date: Mar. 11, 2021

(65) Prior Publication Data

US 2022/0361574 A1 Nov. 17, 2022

(30) Foreign Application Priority Data

Sep. 6, 2019 (EP) ..... 19195881

(51) Int. Cl.
*A24F 40/46* (2020.01)
*A24F 40/42* (2020.01)

(52) U.S. Cl.
CPC ..... *A24F 40/46* (2020.01); *A24F 40/42* (2020.01)

(58) Field of Classification Search
CPC ..... A24F 40/20; A24F 40/46; A24F 40/465
See application file for complete search history.

(56) References Cited

U.S. PATENT DOCUMENTS 5,249,586 A * 10/1993 Morgan ..... A24F 40/46 131/194
2016/0120221 A1* 5/2016 Mironov ..... A24F 40/42 392/395

(Continued)

FOREIGN PATENT DOCUMENTS

CN 108354234 A 8/2018
CN 207836767 U 9/2018

(Continued)

OTHER PUBLICATIONS

International Search Report for Application No. PCT/EP2020/074850 mailed Dec. 9, 2020, pp. 1-5.

(Continued)

*Primary Examiner* — Katherine A Will
(74) *Attorney, Agent, or Firm* — Lerner David LLP

(57) ABSTRACT

A heating chamber for an aerosol generation device includes an open first end through which a substrate carrier including aerosol substrate is insertable along a length of the heating chamber. The heating chamber further includes a side wall, and a plurality of thermal engagement elements for contacting and providing heat to the substrate carrier. The heating chamber further includes a plurality of gripping elements, spaced apart from the thermal engagement elements along a length of the side wall, each gripping element extending inwardly from the interior surface of the side wall into the interior volume at a different location around the side wall, wherein the gripping elements are located closer to the open first end than the thermal engagement elements.

27 Claims, 13 Drawing Sheets

(56) References Cited

U.S. PATENT DOCUMENTS

| | | | | |
|---|---|---|---|---|
| 2019/0098930 | A1* | 4/2019 | Fallon | A61M 11/042 |
| 2019/0150508 | A1* | 5/2019 | Thorsen | H05B 3/40 |
| 2019/0166909 | A1 | 6/2019 | Reevell | |
| 2019/0230989 | A1 | 8/2019 | Fursa et al. | |
| 2020/0093177 | A1 | 3/2020 | Han et al. | |
| 2021/0378308 | A1 | 12/2021 | Reevell | |
| 2022/0167681 | A1* | 6/2022 | Wu | A24F 40/40 |

FOREIGN PATENT DOCUMENTS

| | | | |
|---|---|---|---|
| CN | 109068738 | A | 12/2018 |
| CN | 109640717 | A | 4/2019 |
| CN | 112804894 | A | 5/2021 |
| KR | 20180070454 | A | 6/2018 |
| WO | 2017186455 | A1 | 11/2017 |
| WO | 2018050735 | A1 | 3/2018 |
| WO | 2018110834 | A2 | 6/2018 |

OTHER PUBLICATIONS

Search Report dated Mar. 21, 2024 from the Office Action for Chinese Application No. 202080061594.0 issued Mar. 26, 2024, pp. 1-2.

* cited by examiner

AEROSOL GENERATION DEVICE AND HEATING CHAMBER THEREFOR

The present application is a national phase entry under 35 U.S.C. § 371 of International Application No. PCT/EP2020/074850, filed Sep. 4, 2020, published in English, which claims priority to European Application No. 19195881.8 filed Sep. 6, 2019, the disclosures of which are incorporated herein by reference.

FIELD OF THE DISCLOSURE

The present disclosure relates to an aerosol generation device and to a heating chamber therefor. The disclosure is particularly applicable to a portable aerosol generation device, which may be self-contained and low temperature. Such devices may heat, rather than burn, tobacco or other suitable materials by conduction, convection, and/or radiation, to generate an aerosol for inhalation.

BACKGROUND TO THE DISCLOSURE

The popularity and use of reduced-risk or modified-risk devices (also known as vaporisers) has grown rapidly in the past few years as an aid to assist habitual smokers wishing to quit smoking traditional tobacco products such as cigarettes, cigars, cigarillos, and rolling tobacco. Various devices and systems are available that heat or warm aerosolisable substances as opposed to burning tobacco in conventional tobacco products.

A commonly available reduced-risk or modified-risk device is the heated substrate aerosol generation device or heat-not-burn device. Devices of this type generate an aerosol or vapour by heating an aerosol substrate that typically comprises moist leaf tobacco or other suitable aerosolisable material to a temperature typically in the range 100° C. to 300° C. Heating an aerosol substrate, but not combusting or burning it, releases an aerosol that comprises the components sought by the user but less or no carcinogenic by-products of combustion and burning.

In general terms it is desirable to rapidly heat the aerosol substrate to, and to maintain the aerosol substrate at, a temperature at which an aerosol may be released therefrom without burning. It will be apparent that the aerosol released in the heating chamber from the aerosol substrate is delivered to the user when there is air flow passing through the aerosol substrate.

Aerosol generation devices of this type are portable devices and so energy consumption is an important design consideration. The present invention aims to address issues with existing devices and to provide an improved aerosol generation device and heating chamber therefor.

SUMMARY OF THE DISCLOSURE

According to a first aspect of the disclosure, there is provided a heating chamber for an aerosol generation device, the heating chamber comprising: an open first end through which a substrate carrier including aerosol substrate is insertable in a direction along a length of the heating chamber; a side wall defining an interior volume of the heating chamber; a plurality of thermal engagement elements for contacting and providing heat to the substrate carrier, each thermal engagement element extending inwardly from an interior surface of the side wall into the interior volume at a different location around the side wall; and a plurality of gripping elements, spaced apart from the thermal engagement elements along a length of the side wall, each gripping element extending inwardly from the interior surface of the side wall into the interior volume at a different location around the side wall; wherein the gripping elements are located closer to the open first end than the thermal engagement elements.

It has been found that as the aerosol substrate is heated, the aerosol substrate shrinks away from the thermal engagement elements and the compression force to maintain the substrate carrier in the heating chamber and prevent it falling out is no longer optimal. Therefore, the plurality of gripping elements is provided to mitigate this problem and provide additional gripping of the substrate carrier.

Optionally, the thermal engagement elements and/or the gripping elements comprise a deformed portion of the side wall.

Optionally, the thermal engagement elements and/or the gripping elements comprise an embossed portion of the side wall.

Optionally, the side wall, the thermal engagement elements, and the gripping elements are formed as a single integral part.

Optionally, the side wall has a substantially constant thickness lower than 1.2 mm, preferably of 1.0 mm or lower, most preferably between 0.9 (+/−0.01) and 0.7 (+/−0.01) mm.

Optionally the side wall is formed from metal.

Optionally, the heating chamber has a central axis along which the substrate carrier is insertable; and wherein each gripping element has an innermost portion for contacting the substrate carrier, wherein the innermost portions are all located substantially at the same radial distance from the central axis.

Optionally the heating chamber has a central axis along which the substrate carrier is insertable; wherein the gripping elements each have an innermost portion for gripping the substrate carrier located a first radial distance from the central axis; and the thermal engagement elements each have an innermost portion for contacting the substrate carrier located a second radial distance from the central axis; the first radial distance being larger than the second radial distance.

In other words, the gripping elements and the thermal engagement elements may define respectively a first restriction diameter and a second restriction diameter of the heating chamber; the first restriction diameter being larger than the second restriction diameter.

In particular, the first restriction diameter defined by the gripping elements is at least 0.05 mm larger, preferably between 0.1 and 0.5 mm larger, most preferably between 0.1 and 0.3 mm, larger than the restriction diameter defined by the thermal engagement elements. For example, the first restriction diameter is 6.4 (+1-0.05) mm and the second restriction diameter is 6.2 (+1-0.05) mm. Such difference of restriction diameters compensates for the difference of rigidity of the substrate carrier in the regions where the elements are engaged with the substrate carrier. In particular, the thermal engagement elements are preferably positioned in a region of the substrate carrier where the aerosol substrate, e.g. a tobacco-based substrate, is present. In this region, the substrate carrier, due to the compressibility of the aerosol substrate, has the ability to deform quite easily. The gripping elements are positioned in a more rigid region of the substrate carrier, not containing aerosol substrate, for example, against a tube or filter of the substrate carrier. Due to the rigidity of the material in this zone, the substrate carrier deforms less easily and so the gripping elements are preferably sized to provide sufficient gripping without conferring too much resistance or deformation of the substrate carrier.

In other words, optionally the first radial distance is at least 0.05 mm larger, preferably between 0.1 and 0.5 mm larger, most preferably between 0.1 and 0.3 mm, than the second radial distance.

Optionally, the thermal engagement elements have generally an elongated shape extending along an axial length of the heating chamber. The thermal engagement elements preferably have the same shape as one another. The elongated thermal engagement elements preferably form elongated ridges on the inner surface of the heating chamber and complementary grooves on the outer surface of the heating chamber corresponding to the elongated ridges. Optionally, the thermal engagement elements have a different profile in a plane parallel to the length of the heating chamber from a profile of the gripping elements in a plane parallel to the length of the heating chamber.

Optionally, the thermal engagement elements have a profile in a plane parallel to the length of the heating chamber based on a polygon having a plurality of straight edges where adjacent straight edges meet at corners. Optionally, one or more of the corners of the thermal engagement elements are rounded.

Optionally, the gripping elements have generally the same shape as one another.

Optionally, the gripping elements are shaped differently from the thermal engagement elements.

Optionally, the number of thermal engagement elements is the same as the number of gripping elements.

Optionally, the thermal engagement elements extend a first distance along the length of the side wall and the gripping elements extend a second distance along the length of the side wall, wherein the first distance is greater than the second distance.

Preferably, the gripping elements have a length shorter than a length of the thermal engagement elements. The length is the axial extent along the length of the side wall of the heating chamber.

Preferably, the gripping elements have a width substantially equal to their length. The width is the extent around the inner surface of the side wall. For a circular side wall, the width may be referred to as the circumferential width. The width is transverse to the length.

The thermal engagement elements are preferably elongate to enable an extended surface area for heat transmission whereas the gripping elements just need to mechanically grip on the substrate carrier, and therefore can be shorter than the thermal engagement elements. If the gripping elements are too long, some heat could be provided via the gripping elements to a zone of the substrate carrier which is preferably not heated due to proximity to the user's mouth.

Optionally, the thermal engagement elements have a length which is at least 3 times as long as their extent in a transverse direction around the side wall. As used herein, the transverse direction is the width around the side wall. Preferably, the thermal engagement elements have a length which is between 20 and 30 times as long as their extent in a transverse direction (i.e. width) around the side wall. For example, the thermal engagement elements have a length of between 8 and 15 mm, such as 12.5 mm, and a width of 0.3 mm and 1 mm, such as 0.5 mm.

Optionally, the gripping elements have a length which is less than 2 times as long as their extent in a transverse direction around the side wall. For example, the gripping elements have a length which is substantially as long as their extent in a transverse direction (i.e. width) around the side wall. For example, the gripping elements have a length between 0.3 and 1 mm, such as 0.5 mm and a width between 0.3 and 1 mm such as 0.5 mm. Such dimensions provide sufficient gripping of the substrate carrier while avoiding too much resistance during insertion or removal as well as reducing the heat transfer from the heated side wall to the upper zone of the substrate carrier which is closer to the mouth end of the substrate carrier.

Optionally, the thermal engagement elements and/or the gripping elements have a profile in a plane parallel to the length of the heating chamber which is convex Optionally, at least one of the gripping elements has a pointed or rounded profile projecting inwardly into the interior volume, preferably wherein the pointed profile is triangular or the rounded profile is a portion of a sphere.

Optionally, the gripping elements have a surface facing towards the first open end which slopes away from the open first end towards a central axis of the heating chamber.

The gripping elements may be formed as embossed dimples formed in the outer wall of the heating chamber. Such design provides a limited heat transfer but a firm gripping action. The gripping dimples may be a curved innermost portion joining the side wall at a circumference which is substantially circular, elliptical, square or rectangular. The tip (innermost interior portion) of the gripping element is preferably rounded or flat to avoid tearing the surface of the substrate carrier (e.g. tipping paper). For example, the dimple may form a profile which is partially elliptical, a hemi-spherical or trapezoidal in a plane parallel to the length of the heating chamber at its innermost portion. The dimples are formed in the outer surface of the heating chamber, and may have a cavity comprising a substantially hemispherical innermost portion and an annular outermost portion joining the tubular side wall. The annular outermost portion may connect to the side wall by a slight curved portion e.g. having a radius of around 0.1 mm. For example, the diameter of the outermost portion may be between 0.3 and 1 mm, preferably between 0.4 and 0.7 mm, for example 0.6 mm and the radius of the spherical innermost portion may be, for instance, about 0.15 mm.

Optionally, the thermal engagement elements have a flattened profile shaped for distributed compression, preferably a trapezoidal profile. In particular, the thermal engagement elements have a surface adapted for heat transfer to the substrate carrier by maximising the surface area in contact. For example, this contact surface may be complementary to the shape of the substrate carrier. The contact surface may be the surface of the thermal engagement element extending furthest into the interior volume of the heating chamber.

Optionally, relative to the side wall, the thermal engagement elements protrude a third distance into the interior volume of the heating chamber and the gripping elements extend a fourth distance into the interior volume of the heating chamber. Preferably, the third distance is larger than the fourth distance. In this manner, the thermal engagement elements protrude further into the interior volume of the heating chamber than the gripping elements Optionally, for uniform heat distribution, the plurality of thermal engagement elements are equally spaced apart from one another around the side wall. For uniform gripping force distribution on the substrate carrier and central substrate carrier axial alignment in the heating chamber, the plurality of gripping elements may also be equally spaced apart from one another around the side wall.

Optionally, the heating chamber further comprises a heat generator arranged to provide heat to the substrate carrier.

Optionally, the heat generator is a heater. Optionally, the heat generator is an electrical heater. Preferably, the heat generator is a resistive electrical heater such as a thin-film heater having a metallic heating track on a backing film.

Optionally, the heat generator is an electrical heat generator comprising a metallic heating track on an electrically insulating backing layer.

Optionally, the heat generator is located on a portion of an outer surface of the side wall.

Optionally, the heat generator is located so as to extend a fifth distance along the side wall such that at least part of the heat generator is located adjacent to at least part of a portion of the side wall corresponding to the location of the thermal engagement elements.

Optionally, the heat generator is located such that the heat generator is not located adjacent to any part of a portion of the side wall corresponding to the location of the gripping elements.

Optionally, the heat generator extends along only a portion of the side wall.

Optionally, the heat generator extends along a portion of the side wall spaced away from the open first end.

Optionally, the heat generator is spaced away from the open first end by a sixth distance and spaced away from the second end opposite the open first end by a seventh distance, wherein the sixth and seventh distances are different.

Optionally, the heating chamber further comprises a metallic layer between the heat generator and the side wall.

Optionally, the metallic layer extends further along the length of the heating chamber than the heat generator does.

Optionally, the metallic layer is an electroplated layer, preferably an electroplated copper layer.

Optionally, the heat generator comprises an electric heat generator having metallic tracks and an electrically insulating backing layer.

Optionally, the heat generator is compressed against the side wall by a heat shrink layer under tension.

Optionally, the heating chamber further comprises a flange at the open first end.

Optionally, the heating chamber further comprises a bottom at a/the second end of the side wall, opposite the open first end. The bottom may otherwise be referred to as a base.

Optionally, the side wall has a first thickness and the bottom has a second thickness, wherein the second thickness is greater than the first thickness.

Optionally, the bottom includes a platform extending from a portion of the bottom towards the open first end from an interior surface of the bottom.

Optionally, the platform is formed from a portion of the bottom.

Optionally, the platform comprises a deformed portion of the bottom.

Optionally, the side wall is a tubular side wall. Optionally, the side wall is a cylindrical side wall.

Optionally, the heating chamber further comprises the substrate carrier, the substrate carrier having a first portion and a second portion, wherein the first portion is positioned further from the open first end than the second portion when the substrate carrier is inserted into the heating chamber, and wherein the first portion includes an aerosol substrate.

Preferably, the thermal engagement elements are arranged to contact the first portion of the substrate carrier. Therefore, the heat can be concentrated via contact by the thermal engagement elements towards the aerosol substrate contained in the first portion. As a result of the local engagement of the elements to the first portion of the carrier, air gaps are provided between adjacent thermal engagement elements and the substrate carrier allowing air to be drawn from the open first end towards the second end or bottom end of the heating chamber.

Optionally, the gripping elements are arranged to grip the second portion of the substrate carrier.

The second portion of the substrate carrier preferably does not comprise aerosol substrate.

Optionally, the second portion of the substrate carrier is a hollow tube.

The second portion of the substrate carrier may be a filter and/or a cooling tube. The filter and/or cooling tube may be wrapped by paper and/or film (e.g. plug wrap, tipping paper and/or metalized or metal film).

Optionally, the longitudinal end of the thermal engagement elements closest to the open first end is aligned with a boundary between the first and second portions of the substrate carrier when the substrate carrier is inserted into the heating chamber.

Optionally, the thermal engagement elements extend into the interior volume to contact the substrate carrier when the substrate carrier is inserted into the heating chamber.

Optionally, the gripping elements extend into the interior volume to grip the substrate carrier when the substrate carrier is inserted into the heating chamber.

According to a second aspect of the disclosure, there is provided an aerosol generation device comprising: an electrical power source; the heating chamber as disclosed herein; a/the heat generator arranged to supply heat to the heating chamber; control circuitry configured to control the supply of electrical power from the electrical power source to the heat generator; and an outer housing enclosing the electrical power source, the heating chamber, the heat generator, and the control circuitry, wherein the outer housing has an aperture formed therein for accessing the interior volume of the heating chamber.

Optionally, the aerosol generation device further comprises an insulating member surrounding the heating chamber.

Optionally, the insulating member is a vacuum insulating member. For example, the vacuum insulating member comprises a double-walled metal tube or cup having a vacuum contained between the walls.

Optionally, the insulating member comprises a thermally insulating material. For example, the thermally insulating material includes rubbers (such as silicone, silicone foam, polyurethane foam, and the like), aerogel, or fiberglass insulators.

Embodiments of the disclosure are described below, by way of example only, with reference to the accompanying drawings.

DETAILED DESCRIPTION

Referring to FIGS. 1 to 4, an aerosol generation device 100 is provided. The aerosol generation device 100 is arranged to receive a substrate carrier 132 comprising an aerosol substrate 134 and is configured to heat the aerosol substrate 134 inserted therein to form an aerosol for inhalation by a user. The aerosol generation device 100 may be described as a personal inhaler device, an electronic cigarette (or e-cigarette), vaporiser or vaping device. In the illustrated example, the aerosol generation device 100 is a Heat not Burn (HnB) device. However, aerosol generation devices 100 that are envisaged in the disclosure more generally heat or agitate an aerosolisable substance to generate an aerosol for inhalation, as opposed to burning tobacco as in conventional tobacco products.

Figure 1:
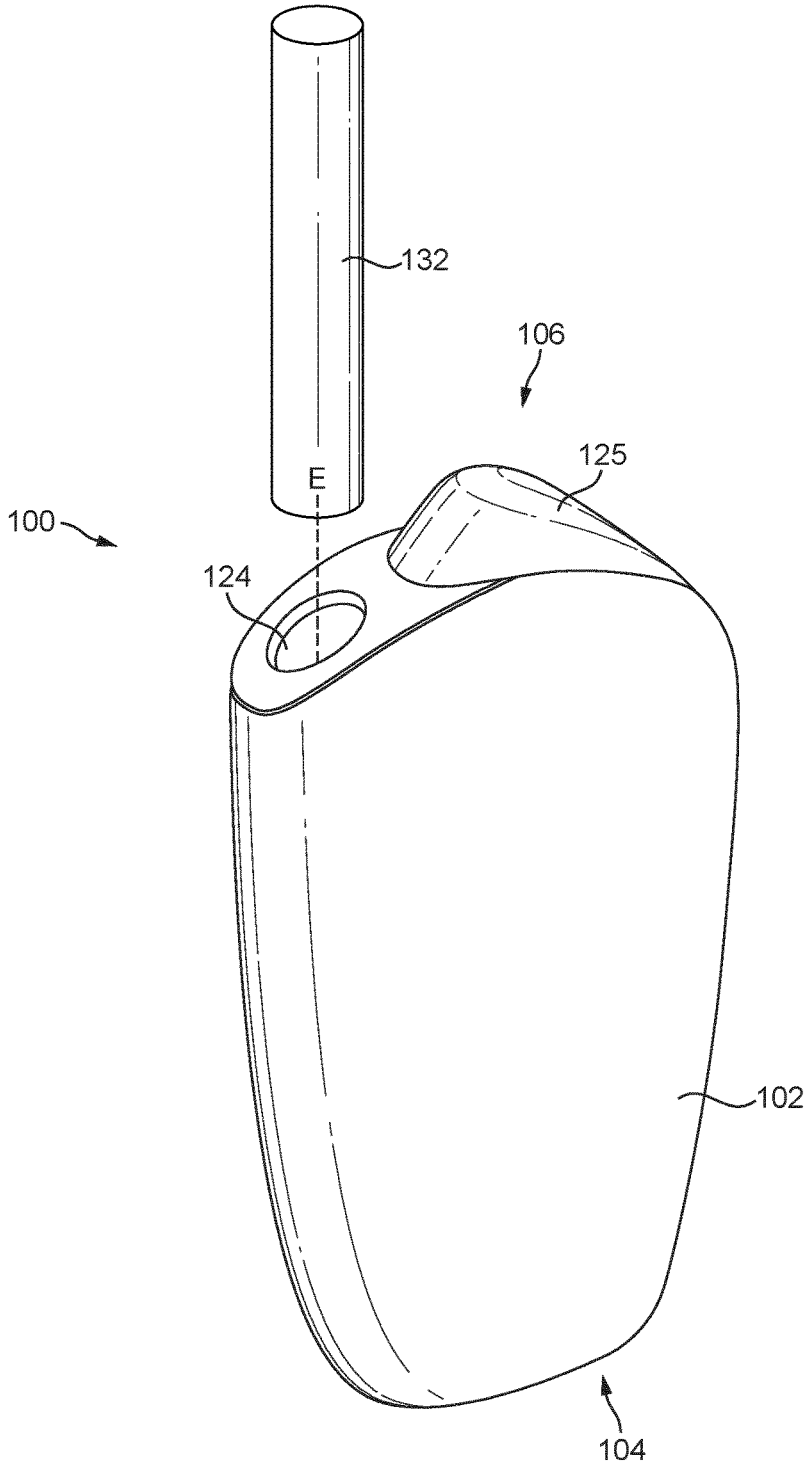
FIG. 1 is a schematic perspective view of an aerosol generation device according to the disclosure, shown with a substrate carrier including aerosol substrate being loaded into the aerosol generation device.

Referring to FIG. 1, the aerosol generation device 100 comprises an outer casing 102 housing various components of the aerosol generation device 100. The outer casing 102 can be formed of any suitable material, or indeed layers of material. For example an inner layer of metal can be surrounded by an outer layer of plastic or other material with low thermal conductivity. This allows the outer casing 102 to be pleasant for a user to hold.

In the example shown, the elongate aerosol generation device 100 has a first end 104 and a second end 106 opposite the first end 104. The first end 104, shown towards the bottom of FIGS. 1 to 4, is described for convenience as a bottom, base, or lower end of the aerosol generation device 100. The second end 106, shown towards the top of FIGS. 1 to 4, is described for convenience as a top or upper end of the aerosol generation device 100. During use, a user typically orients the aerosol generation device 100 with the first end 104 downward and/or in a distal position with respect to the user's mouth and the second end 106 upward and/or in a proximate position with respect to the user's mouth.

The outer casing 102 has an opening 124 for receiving the substrate carrier 132 therethrough to be heated in a heating chamber inside the outer casing 102. In this example, the opening 124 is shown towards the second end 106. The aerosol generation device 100 has a closure 125 for covering the opening 124. The closure 125 might be considered a door for the opening 124. The closure 125 is configured selectively to cover and uncover the opening 124, such that the opening 124 is substantially closed and open depending upon the position of the closure 125. In the closed configuration, this can prevent dust and moisture from entering the opening 124. FIG. 1 shows the closure 125 in the open configuration, exposing the opening 124 for insertion of the substrate carrier 132. The closure 125 may also function as a user-operable button. The closure 125 is depressible when in the open configuration to activate the aerosol generation device 100 to heat the aerosol substrate 134 within the heating chamber 108 to produce aerosol.

Figure 2:
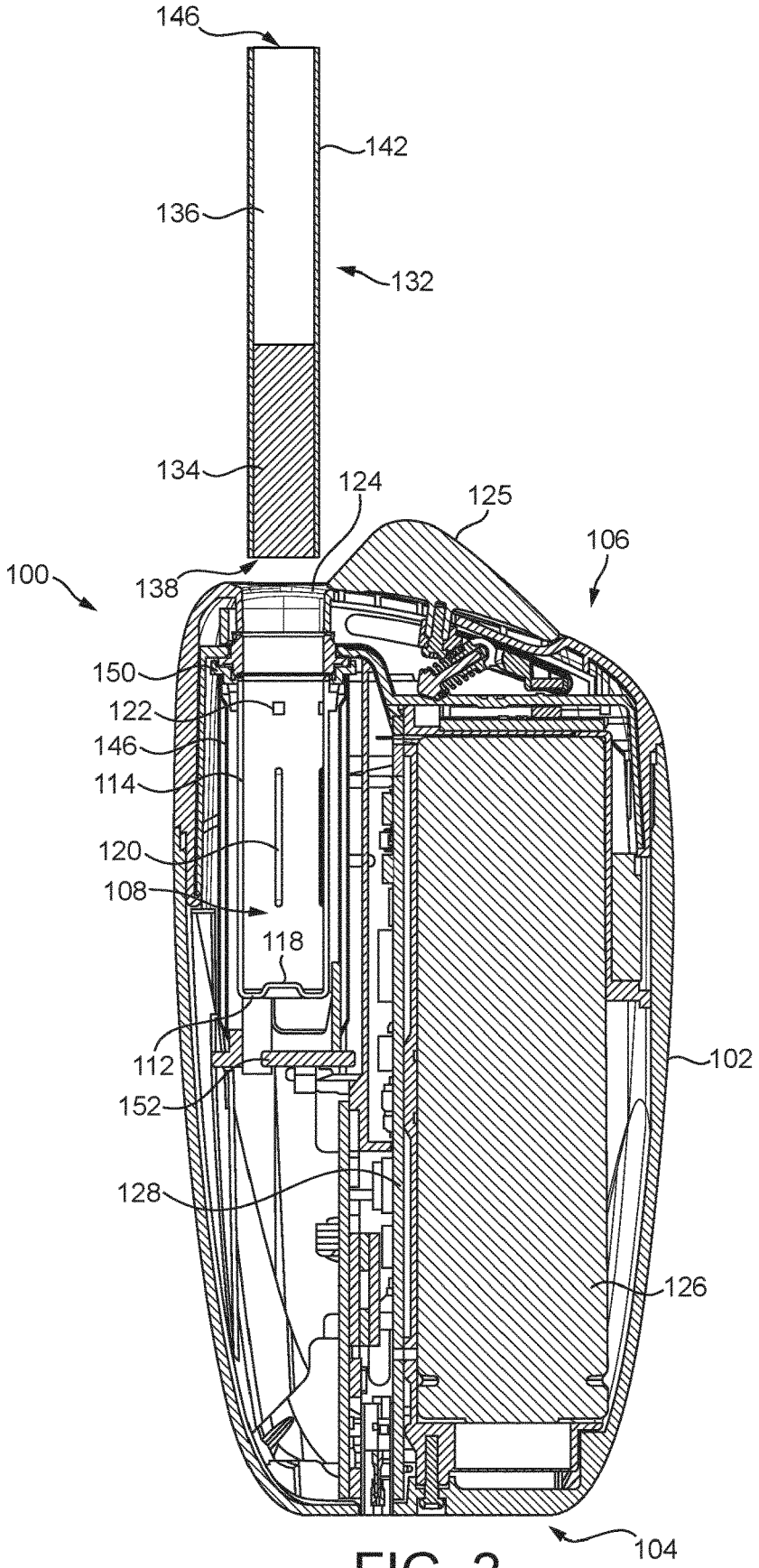
FIG. 2 is a schematic cross-sectional view from a side of the aerosol generation device of FIG. 1, shown with the substrate carrier including aerosol substrate being loaded into the aerosol generation device.

Referring to FIG. 2, the aerosol generation device 100 comprises the heating chamber 108 located towards the second end 106 of the aerosol generation device 100. The heating chamber 108 is arranged towards the opening 124 in the aerosol generation device 100 adjacent the second end 106. In other examples, the heating chamber 108 is located elsewhere within the aerosol generation device 100. The heating chamber 108 is arranged within the aerosol generation device 100 such that it is enclosed by the outer casing 102.

The heating chamber 108 is generally a cup shape. The heating chamber 108 extends along a central axis E, such that an axial length of the heating chamber 108 is substantially aligned with the central axis E. The heating chamber 108 comprises an open end 110 which is arranged towards the second end 106 of the aerosol generation device 100. In FIG. 1, the open end 110 is aligned with the opening 124 at the second end 106 of the aerosol generation device 100. The heating chamber 108 is closed at an end opposite the open end 110. In other words, the heating chamber 108 comprises a base 112 opposite the open end 110. The base 112 may otherwise be referred to as a bottom of the heating chamber 108.

The heating chamber 108 also comprises a side wall 114. The side wall 114 is arranged to be thin-walled, preferably having a thickness of 80-100 μm. In this example, the side wall 114 is tubular and has a generally circular cross-section. In this regard, the side wall 114 may generally be referred to as the tubular wall of the heating chamber 108. Thus, the heating chamber 108 is generally cylindrical. However, other shapes are envisaged, and the heating chamber 108 may have a broadly tubular shape with, for example, an elliptical or polygonal cross section. In other examples, the side wall 114 tapers along its length such that the cross-sectional area defined by the side wall 114 perpendicular to its length is different at the open end 110 than at the base 112. The heating chamber 108 has a generally tubular shape substantially aligned with the axial length of the aerosol generation device 100.

In this example, the central axis E is aligned with the centroid of the circular cross section of the side wall 114, and is the geometric central axis of the cylindrical side wall 114.

The length of the side wall 114 is parallel to the central axis E. The length of the side wall 114 is defined as the dimension between the base 112 and the open end 110.

As used herein, "diameter" refers to a width, and in cases where the side wall 114 does not have a circular cross section, it is to be understood that "diameter" refers to a width of the cross section, and in particular a smallest width of the cross section which runs through a centroid of the cross section (i.e. through the central axis E). For example, where the side wall 114 has a square cross section, the side wall 114 has a width being the distance between two opposing faces of the square measured perpendicular to the two opposing faces.

As used herein, "circumference" refers to a perimeter, and in cases where the side wall 114 does not have a circular cross section, it is to be understood that "circumference" refers to an outer perimeter of the cross section.

The base 112 forms an end face of the cylindrical heating chamber 108. The heating chamber 108 has an interior volume defined by the side wall 114 and the base 112. The side wall 114 connects the base 112 to the open end 110 to form the cup shape of the heating chamber 108. In other examples, the heating chamber 108 has one or more holes, or is otherwise perforated at the base 112. In yet a further example, the heating chamber 108 may be provided without a base 112 and is a tube open at both ends. In such cases, the length of the heating chamber 108 is the shortest distance along the side wall 114 between the open ends.

The heating chamber 108 also comprises a flange 116 at the open end 110, and a platform 118 in the base 112. The side wall 114 comprises a plurality of thermal engagement elements 120, and a separate plurality of gripping elements 122. The heating chamber 108 will be described in more detail with reference to FIGS. 5 to 9 below.

The heating chamber 108 is arranged to receive a substrate carrier 132 comprising an aerosol substrate 134. For instance, the aerosol substrate 134 may contain a mixture of tobacco and humectant. The heating chamber 108 is configured to heat the aerosol substrate 134 within the substrate carrier 132 to generate an aerosol for inhalation, as will be described below.

Referring to FIG. 2, the aerosol generation device 100 comprises an electrical power source 126. Hence, the aerosol generation device 100 is electrically powered. That is, it is arranged to heat the aerosol substrate 134 using electrical power. In this example, the electrical power source 126 is a battery. The electrical power source 126 is coupled to control circuitry 128. The control circuitry 128 is in turn coupled to a heat generator 130.

For example, the heat generator 130 may be an electrical heat generator. More specifically, the heat generator 130 may be a resistive electrical heat generator having a heating element in the form of a metallic track on a backing film. For example, the heat generator 130 may be a thin-film heater such as a resistive heating track enveloped in an electrically insulating film such as polyimide. When a current is passed through the heating element, the heating element heats up and increases in temperature. In another example, the heat generator 130 may be an inductive heater. In this case, the heat generator 130 may refer to an induction heating source, a susceptor, or both.

The user-operable button of the closure 125 is arranged to cause coupling and uncoupling of the electrical power source 126 to the heat generator 130 via the control circuitry 128. In other examples, the heating chamber 108 is heated in other ways, e.g. by burning a combustible gas.

The heat generator 130 is attached to the outside surface of the heating chamber 108 and in thermal contact with outside surface of the side wall 114 to allow for good transfer of heat from the heat generator 130 to the heating chamber 108. The heat generator 130 extends around the heating chamber 108. In particular, the heat generator 130 is in contact with the external surface of the side wall 114. In more detail, the heat generator 130 extends around the side wall 114, but not around the base 112.

As will be described in more detail below, the heating chamber 108 comprises a plurality of thermal engagement elements 120 shown as indentations in the side wall 114 of FIG. 2. As used herein, when the heat generator 130 is described as in contact around the entire side wall 114, it is to be understood that this means the heat generator 130 extends around the entire perimeter of the side wall 114, although it may not be in full contact with the side wall 114 at all points, in particular inside the indentations of the thermal engagement elements 120.

In FIG. 1, the heat generator 130 extends over part of the length of the side wall 114. The heat generator 130 may not extend over the length of the entire side wall 114, but the heat generator 130 preferably extends all the way around the side wall 114. The length in this context is taken from the base 112 to the open end 110. The heat generator 130 may not necessarily extend to one or more ends of the side wall 114. In particular, the heat generator 130 may not extend to the end of the side wall 114 adjacent the open end 110 and/or the heat generator 130 does not extend to the end of the side wall 114 adjacent the base 112. In this example, the heat generator 130 is mounted generally centrally along the height of the side wall 114. That is, the heat generator 130 does not extend to either end of the side wall 114. In other words, the heat generator 130 is spaced away from the end of the side wall 114 adjacent the open end 110 and from the end of the side wall 114 adjacent the base 112.

When the substrate carrier 132 is inserted into the heating chamber 108, the heat generator 130 is arranged to substantially overlap with the region of aerosol substrate 134. Preferably, the aerosol substrate 134 is fully inserted into the heating chamber 108 such that the top part of the heating chamber 108 towards the open end 110 is arranged to overlap with part of the substrate carrier 132 not including the aerosol substrate 134, when inserted. In other words, parts of the substrate carrier 132 not comprising aerosol substrate 134 are aligned with the open end 110. It is preferable to restrict heating of these components to improve heating efficiency by focusing heating on the aerosol substrate 134. By not overlapping the heat generator 130 with a portion of the side wall 114 towards the open end 110, heat generated by the heat generator 130 is localised. The side wall 114 is preferably very thin (typically less than 100 μm), to assist in this goal by restricting thermal transmission along the thin side wall 114. This can reduce heat transfer to parts not covered by the heat generator 130. Additionally, by inhibiting heating towards the base 112, this prevents burning the tip of the substrate carrier 132. In this way a further distinction is made between the roles provided by the thermal engagement elements 120 and the gripping elements 122. More specifically, the thermal engagement elements 120 are arranged to receive heat generated by the heat generator 130 and transmit the heat into the aerosol substrate 134. Conversely, the heating chamber 108 as a whole is arranged to inhibit heat flow to the gripping elements 122 and/or to thereafter to the aerosol substrate 134 in the region of the gripping elements 122, by combined effects of localisation of the heat generator 130, the shape of the gripping elements 122 (e.g. arranged to have a small contact area with the substrate carrier 132), and the thin design of the side wall 114 preventing heat transfer along the heating chamber 108. In some examples additional features may be provided such as metallic (e.g. copper) layers for demarking areas which are to be heated (e.g. the thermal engagement elements 120, which may be coated with copper) from those which are not intended to be heated (e.g. the gripping elements 122, which should not be coated). In this way, the various features of the heating chamber 108 described herein operate individually, or in combination to provide the thermal engagement elements 120 and the gripping elements 122 with their different functions.

In alternative examples, the heat generator 130 may extend over the entire length of the side wall 114.

In order to increase thermal isolation of the heating chamber 108, the heating chamber 108 is surrounded by insulation. In this example, an insulating member 146 is an insulating tube. The insulating member 146 may be double-walled having an inner wall and an outer wall separated by an interior space. The top and the bottom of the tube of the insulating member 146 are sealed to connect the inner wall and the outer wall, such that the interior space is enclosed within the insulating member 146. The insulating member 146 comprises a vacuum in the interior space to further improve the thermal insulation, and in other embodiments may comprise an insulating material such as hydrogel or foam.

Figure 5A:
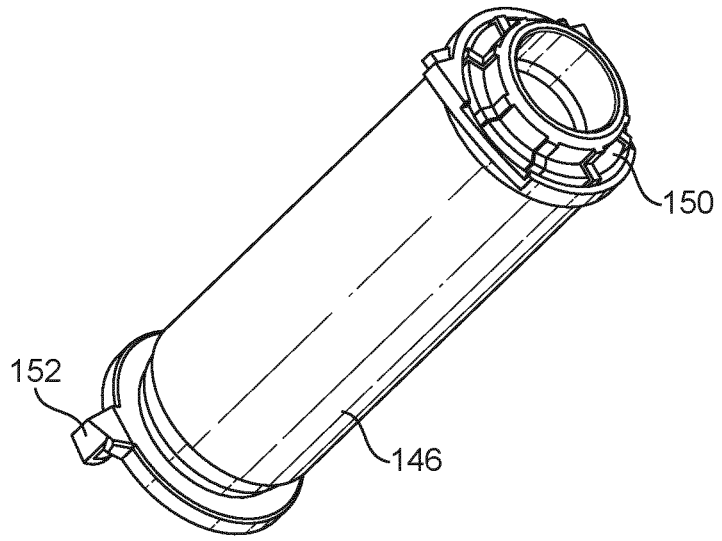
FIG. 5A is a perspective and cross-sectional view of the heating chamber according to the disclosure in combination with an insulating member and upper and lower support members.
Figure 5A:
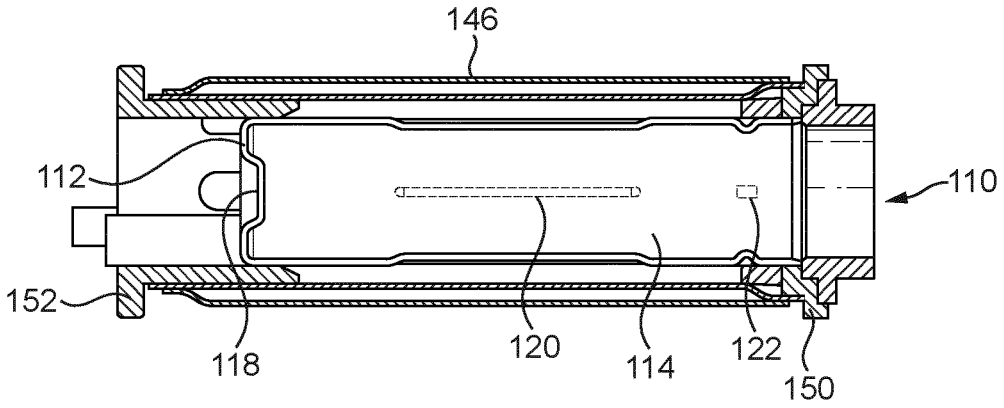

In this example, the heating chamber 108 is secured to the aerosol generation device 100 by the flange 116. The heating chamber 108 is mounted to the aerosol generation device 100 by at least one support member 150, 152. In FIG. 2, the aerosol generation device 100 comprises an upper support member 150 and a lower support member 152. Referring to FIG. 5A, the mounted heating chamber 108 is shown in more detail. The upper support member 150 is configured to secure to the flange 116 of the heating chamber 108. In alternative embodiments, the upper support member 150 surrounds the outer surface of the side wall 114 towards the open end 110, for instance in examples where a flange 116 is not provided. The upper support member 150 engages between the heating chamber 108 and the insulating member 146. The lower support member 152 is configured to secure the base 112 of the heating chamber 108. The heating chamber 108 is thus held at each end and fixed in position relative to the insulating member 146. Preferably, the support members 150, 152 are made from a thermally insulating material to improve thermal isolation between the heating chamber 108 and the insulating member 146. The assembly of the heating chamber 108 and the insulating member 146 coupled by the support members 150, 152 is then mounted in the aerosol generation device 100, for example by attachment to a frame enclosed within the outer casing 102.

This arrangement means that conduction of heat from the heating chamber 108 to the outer casing 102 of the aerosol generation device 100 is limited by the thermally insulating properties of the support members 150, 152. Providing the heating chamber 108 only attached through the support members 150, 152 provides a well-insulated thermal conduction path for heat to travel, instead of allowing heat to escape directly from the side wall 114 in contact the outer casing 102, for example. This helps keep the outer casing 102 at a comfortable temperature for the user, and improves heating efficiency.

In some examples, the heat generator 130 is held onto the heating chamber 108 from the outside. That is, the heat generator 130 is held onto the heating chamber 108 externally of the heat generator 130 rather than from between the heat generator 130 and the heating chamber 108. For instance, this avoids the use of adhesives between the heat generator 130 and external surface of the side wall 114 of the heating chamber 108. Removing layers between the heat generator 130 and the heating chamber 108 can improve thermal transfer and improve heating efficiencies.

In some examples, the heat generator 130 may be surrounded by a heat shrink material which applies a pressure on the external surface of the heat generator 130 inwards and onto the heating chamber 108. This compressed the heat generator 130 onto the external surface of the heating chamber 108 and promotes thermal contact. A heat shrink material may be wrapped around the heat generator 130 and heated to provide the compressive force.

The heating chamber 108 of the aerosol generation device 100 is arranged to receive the substrate carrier 132. Typically, the substrate carrier 132 comprises an aerosol substrate 134 such as tobacco or another suitable aerosolisable material that is able to be heated to generate an aerosol for inhalation. In this example, the heating chamber 108 is dimensioned to receive a single serving of aerosol substrate 134 in the form of a substrate carrier 132, also known as a "consumable", as shown in FIGS. 1 to 4, for example. However, this is not essential, and in other examples the heating chamber 108 is arranged to receive the aerosol substrate 134 in other forms, such as loose tobacco or tobacco packaged in other ways.

The substrate carrier 132 is a generally tubular and elongate shape. In this example, the substrate carrier 132 is cylindrical and mimics the shape of a cigarette. The substrate carrier 132 has a length of 55 mm, in this example. The substrate carrier 132 has a diameter of 7 mm. The substrate carrier 132 comprises a region of aerosol substrate 134, and an aerosol collection region 136 adjacent to the region of aerosol substrate 134. The aerosol collection region 136 may be a paper or cardboard tube which is less compressible than the aerosol substrate 134. The substrate carrier 132 has a first end 138 and a second end 140 opposite the first end 138. The first end 138 and the second end 140 define the ends of the elongate cylindrical shape of the substrate carrier 132. The aerosol substrate 134 is arranged towards the first end 138. The first end 138 is configured to be inserted into the heating chamber 108. The second end 140 is configured as a mouth-piece for a user to insert into their mouth for inhalation of aerosol produced by heating the aerosol substrate 134.

Generally, the aerosol substrate 134 is arranged at the first end 138 and extends part way along the length of the substrate carrier 132 between the first end 138 and the second end 140. In this example, the aerosol substrate 134 has a length of 20 mm. The aerosol collection region 136 abuts the aerosol substrate 134 and is arranged between the aerosol substrate 134 and the second end 140. In this example, the aerosol collection region 136 does not extend all the way to the second end 140.

If a filter is provided, it is typically provided towards the second end 140. The length of the aerosol collection region 136 is about 20 mm. The length of the aerosol substrate is also about 20 mm. The substrate carrier 132 further comprises an outer layer 146 wrapping the components of the substrate carrier 132. For instance, the outer layer 146 is a paper (e.g. of base weight of about 40-100 gsm).

Referring to FIGS. 1 and 2, the substrate carrier 132 is shown before loading into the aerosol generation device 100. When a user wishes to use the aerosol generation device 100, the user first loads the aerosol generation device 100 with the substrate carrier 132. This involves inserting the substrate carrier 132 into the heating chamber 108. The substrate carrier 132 is inserted into the heating chamber 108 oriented such that the first end 138 of the substrate carrier 132 enters the heating chamber 108. Thus, the substrate carrier 132 is inserted into the heating chamber 108 with the first end 138 towards the base 112. The substrate carrier 132 is inserted as far as it will go until the first end 138 abuts the base 112, and in particular abuts the platform 118 raised above the base 112, as shown in FIG. 4.

Figure 3:
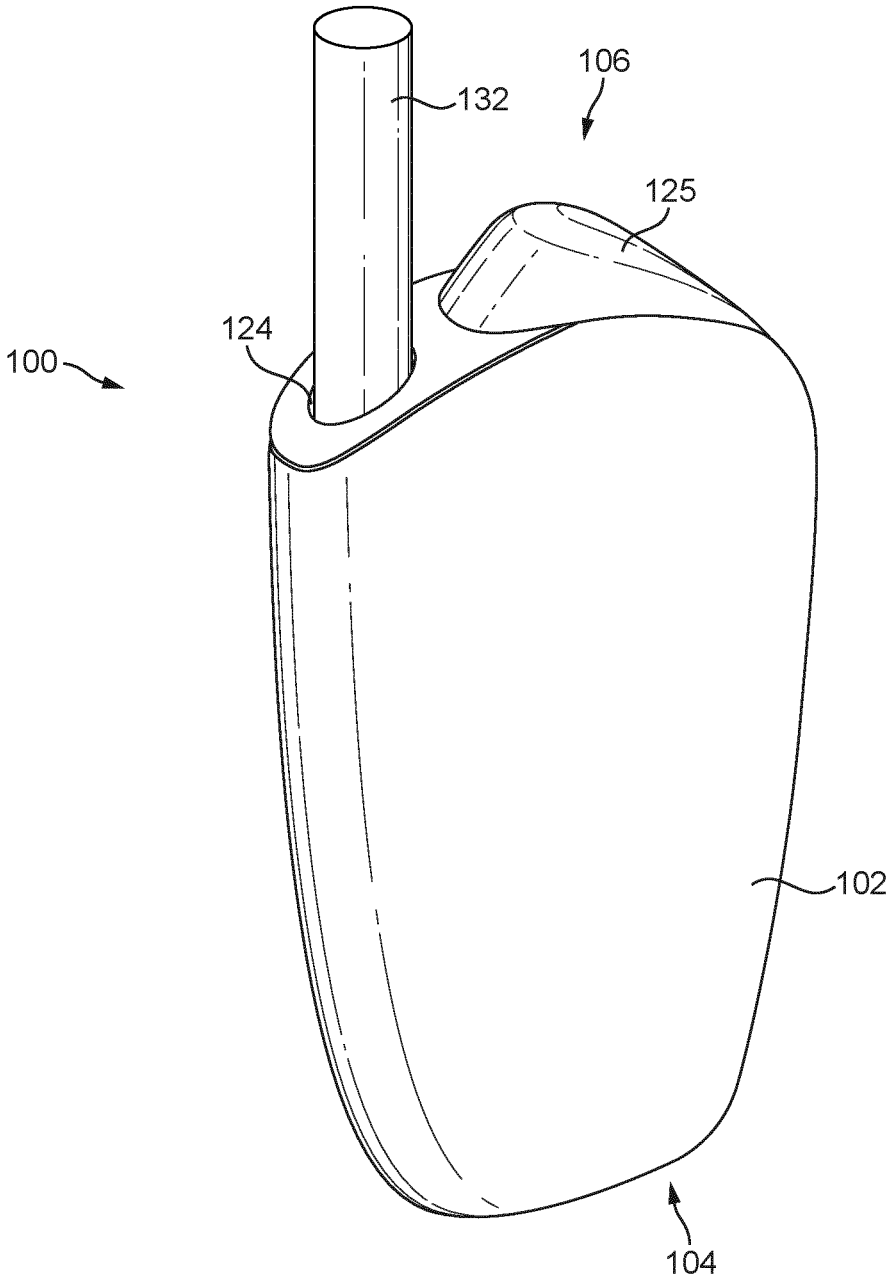
FIG. 3 is a schematic perspective view of the aerosol generation device of FIG. 1, shown with the substrate carrier including aerosol substrate loaded into the aerosol generation device.
Figure 4:
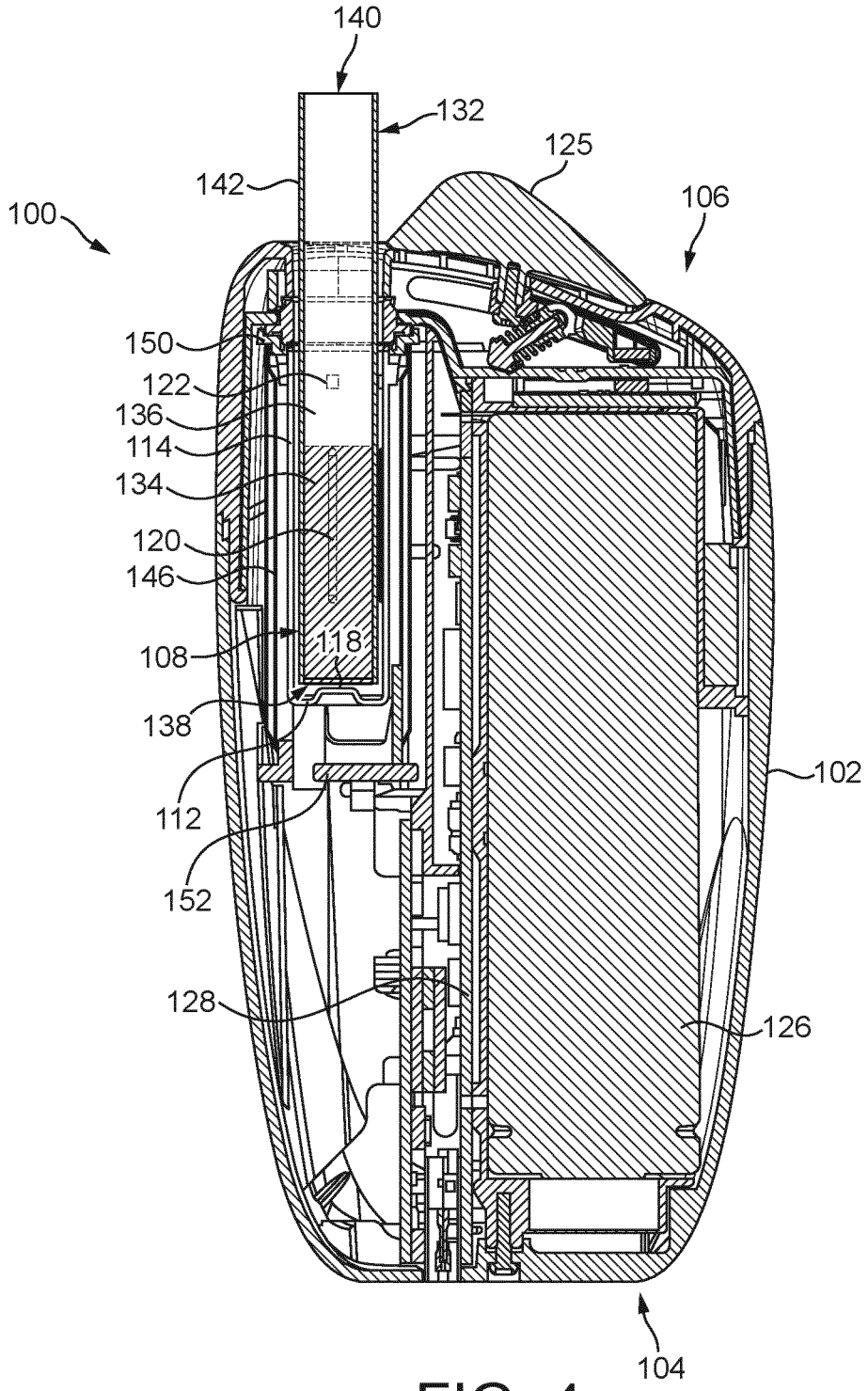
FIG. 4 is a schematic cross-sectional view from the side of the aerosol generation device of FIG. 1, shown with the substrate carrier including aerosol substrate loaded into the aerosol generation device.

It will be seen from FIGS. 3 and 4 that when the substrate carrier 132 has been inserted into the heating chamber 108 as far as it will go, only a part of the length of the substrate carrier 132 is inside the heating chamber 108. In particular, the entirety of the aerosol substrate 134 and most of the aerosol collection region 136 is positioned inside the heating chamber 108. A remainder of the length of the substrate carrier 132 protrudes from the heating chamber 108 and beyond the second end 106 of the aerosol generation device 100. This provides a location for the user to position their mouth on the substrate carrier 132 and inhale the aerosol.

The heat generator 130 causes heat to be conducted through the heating chamber 108 to heat the aerosol substrate 134 of the substrate carrier 132. At least part of the side wall 114 of the heating chamber 108 is arranged in contact with the substrate carrier 132 to enable conduction of heat from the heating chamber 108 to the substrate carrier 132, as described in more detail below with reference to FIGS. 5 to 9, for instance heat is conducted through thermal engagement members 120. Heat is also transferred by convection by heating the surrounding air which is subsequently drawn into the substrate carrier 132.

The heat generator 130 heats the aerosol substrate 134 to a temperature at which it can begin to release vapour. Once heated to a temperature at which the vapour can begin to be released, the user may draw the vapour along the length of the substrate carrier 132 to be inhaled at the user's mouth. The direction of the flow of aerosol through the substrate carrier 132 is indicated by Arrows A in FIG. 4.

It will be appreciated that, as a user sucks air and/or vapour in the direction of Arrows A in FIG. 4, air or a mixture of air and vapour flows from the vicinity of the aerosol substrate 134 in the heating chamber 108 through the substrate carrier 132. This action also draws ambient air into the heating chamber 108 (via flow paths indicated by Arrows B in FIG. 4) from the environment surrounding the aerosol generation device 100 and between the substrate carrier 132 and the side wall 114. The air drawn into the heating chamber 108 is then heated, and drawn into the substrate carrier 132. The heated air heats the aerosol substrate 134 to cause generation of aerosol. More specifically, in this example, air enters the heating chamber 108 through a space provided between the side wall 114 of the heating chamber 108 and the outer layer 146 of the substrate carrier 132. An outer diameter of the substrate carrier 132 is less than an inner diameter of the heating chamber 108, for this purpose. More specifically, in this example, the heating chamber 108 has an internal diameter of 10 mm or less, preferably 8 mm or less and most preferably approximately 7.6 mm. This allows the substrate carrier 132 to have a diameter of approximately 7.0 mm (±0.1 mm). This corresponds to an outer circumference of the substrate carrier 132 of 21 mm to 22 mm. In other words, the space between the substrate carrier 132 and the side wall 114 of the heating chamber 108 is most preferably approximately 0.3 mm. In other variations, the space is at least 0.2 mm, and in some examples it is up to 0.4 mm.

The operation of the heating chamber 108 heating the aerosol substrate 134 to produce an aerosol will now be described in more detail with reference to FIGS. 5 to 9.

Referring to FIGS. 5 to 9, a heating chamber 108 for use with the aerosol generation device 100 of the disclosure is shown in detail. For example, the heating chamber 108 of FIGS. 5 to 9 may be provided in the aerosol generation device 100 described above in relation to FIGS. 1 to 4. As mentioned above, the heating chamber 108 is generally provided to transfer heat from the heat generator 130 arranged on the external surface of the heating chamber 108 to the substrate carrier 134 received into the heating chamber 108 in order to produce an aerosol for inhalation.

The heating chamber 108 comprises a flange 116 located at the open end 110. The flange 116 extends outwardly away from the side wall 114 of the heating chamber 108 by a distance of approximately 1 mm, forming an annular structure. In this example, the flange 116 extends perpendicularly to the height of the side wall 114, such that the flange 116 extends horizontally when the heating chamber 108 is arranged vertically. In alternative examples, the flange 116 may extend at an angle, for example providing an oblique, flared, or sloped flange 116. In some examples, the flange 116 is located only part of the way around the rim of the side wall 114, rather than being annular.

The base 112 of the heating chamber 108 comprises a platform 118 which is raised towards the open end 110 relative to the remainder of the base 112. The platform 118 does not extend over the entirety of the base 112. The platform 118 is arranged towards the centre of the base 112 and provides a space around the platform 118 between the platform 118 and the side wall 114. The platform 118 is configured to space the substrate carrier 132 away from part of the base 112, when the substrate carrier 132 is received into the heating chamber 108. This reduces the contact area of the heating chamber 108 with the first end 138 of the substrate carrier 132 to prevent burning.

Additionally, by exposing part of the first end 138 of the substrate carrier 132, this promotes air flow into the first end 138 of the substrate carrier 132.

In this example, the platform 118 is generally circular, providing an annular space between the platform 118 and the side wall 114 towards the base 112. This allows even air flow into the substrate carrier 132, which can provide uniform heating of the aerosol substrate 134, providing more efficient heating and a more pleasurable experience for a user. Furthermore, the space between the platform 118 and the side wall 114 provides a region that can collect any aerosol substrate 134 which falls out of the substrate carrier 132 at the first end 138. In this example, the platform 118 is circular and has a diameter of approximately 4 mm. In this example, the platform 118 is raised above the remainder of the base 112 by approximately 1 mm.

The side wall 114 is arranged to be thin-walled. Typically, the side wall 114 is less than 100 μm thick, for example around 90 μm, or even around 80 μm thick. In some cases it may be possible for the side wall 114 to be around 50 μm thick. Overall, a range of 50 μm to 100 μm is usually optimal. The manufacturing tolerances are around ±10 μm.

By providing the side wall 114 with such a thickness, the thermal characteristics of the heating chamber 108 change significantly. Transmission of heat through the thickness of the side wall 114 sees negligible resistance because the side wall 114 is so thin resulting in improved thermal conduction from the heat generator 130 to the substrate carrier 132 to be heated. However, thermal transmission along the side wall 114 (that is, along the length of the side wall 114 parallel to a central axis E, or around the circumference of the side wall 114) has a thin channel along which conduction can occur, and so heat produced by the heat generator 130, which is located on the external surface of the heating chamber 108, remains localised close to the heat generator 130 in a radially outward direction from the side wall 114 at the open end 110, but quickly results in heating of the inner surface of the heating chamber 108. In addition, a thin side wall 114 helps to reduce the thermal mass of the heating chamber 108, which in turn improves the overall efficiency of the aerosol generation device 100, since less energy is used in heating the side wall 114.

In some examples, the heating chamber 108 is formed from a material allowing for the localisation of heat as described above. For example, the heating chamber 108, and specifically the side wall 114 of the heating chamber 108, comprises a material having a thermal conductivity of 50 W/mK or less. In this example, the heating chamber 108 is metal, preferably stainless steel. Stainless steel has a thermal conductivity of between around 15 to 40 W/mK, with the exact value depending on the specific alloy. As a further example, the 300 series of stainless steel, which is appropriate for this use, has a thermal conductivity of around 16 W/mK. Suitable examples include 304, 316 and 321 stainless steel, which has been approved for medical use, is strong and has a low enough thermal conductivity to allow the localisation of heat described herein.

In this example, a process of deep drawing is used to provide a cup-shaped heating chamber 108 having a depth greater than its width. This is a very effective method for forming a heating chamber 108 with a very thin side wall 114. The deep drawing process involves pressing a sheet metal blank with a punch tool to force it into a shaped die. By using a series of progressively smaller punch tools and dies, a tubular structure is formed which has a base 112 at one end, and providing a tube which is deeper than the distance across the tube (it is the tube being relatively longer than it is wide which leads to the term "deep drawing"). Due to being formed in this manner, the side wall 114 of a tube formed in this way is the same thickness as the original sheet metal. Similarly, the base 112 formed in this way is the same thickness as the initial sheet metal blank. The flange 116, the thermal engagement elements 120 and the gripping elements 122 can be formed by hydroforming. The operation may comprise a preliminary annealing step to reduce the hardness of the metal and facilitate the deformation. The hydroforming operation can be operated by injecting water under high pressure in the tubular cup to form the side wall 114 against an external mould. The flange 116 may be formed in an annular groove of the mould then be cut to its final shape. The thermal engagement elements 120 and gripping elements 122 can be formed by providing complementary protrusions provided on the surface of the external mould. The mould may be formed of several parts to allow its opening once the forming stage has occurred, so that the heating chamber 108 can be removed from the mould.

Further structural support can be provided by the flange 116 at the open end 110 of the heating chamber 108. The flange 116 resists against bending forces and shear forces on the side wall 114. In this example, the flange 116 is the same thickness as the side wall 114, but in other examples the flange 116 is thicker than the side wall 114 in order to improve the resistance to deformation. Any increased thickness of a particular part for strength is weighed against the increased thermal mass introduced, in order that the aerosol generation device 100 as a whole remains robust but efficient.

Specifically in this example, the heating chamber 108 has a length of around 31 mm. That is, the side wall 114 has a length of around 31 mm. The heating chamber 108 has an inner diameter of around 7.6 mm sized to receive a substrate carrier 132 of diameter around 7 mm. The side wall 114 is 80 μm thick, but the base is 0.4 mm thick to provide additional support.

Alternative suitable dimensions will be readily envisaged to provide the functionality described herein for receiving a substrate carrier.

The heating chamber 108 comprises a plurality of thermal engagement elements 120. The thermal engagement elements 120 are protrusions formed on the inner surface of the side wall 114. Indeed, the terms "thermal engagement element" and "protrusion" may be used interchangeably herein. The width of the thermal engagement elements 120, around the perimeter of the side wall 114 is small relative to their length parallel to the length of the side wall 114. In this example, there are four thermal engagement elements 120.

In this example, the thermal engagement elements 120 are formed as indentations in the side wall 114. The gripping elements 122 may be formed as indentations in the same way. These are formed by deforming the side wall 114 toward the side to form an indentation on the internal surface of the side wall 114 and a recess on the external surface of the side wall 114. Thus, the term "indentation" is also used interchangeably with the terms "protrusion". Forming the thermal engagement elements 120 by indenting the side wall 114 has the advantage that they are unitary with the side wall 114 and hence have a minimal effect on heat flow. In addition, the indented thermal engagement elements 120 and gripping elements 122 do not add any thermal mass, as would be the case if an extra element were to be added to the inner surface of the side wall 114 of the heating chamber 108. Lastly, indenting the side wall 114 as described increases the strength of the side wall 114 by introducing portions extending transverse to the side wall 114, so providing resistance to bending of the side wall 114.

The thermal engagement elements 120 are provided to promote heat transfer from the heat generator 130 into the aerosol substrate 134. The aerosol generation device 100 works by conducting heat from the surface of the thermal engagement elements 120 that engage against the outer layer 142 of the substrate carrier 132. As such, the thermal engagement elements 120 on the inner surface of the side wall 114 contact the substrate carrier 132 when it is inserted into the heating chamber 108. This results in the aerosol substrate 134 being heated by conduction. As used herein, the thermal engagement elements 120 may therefore be referred to as "heat transfer elements" or "conduction elements".

The aerosol generation device 100 also works by heating air in an air gap between the inner surface of the side wall 114 and the outer layer 142 of the substrate carrier 132. That is, there is convective heating of the aerosol substrate 134 as heated air is drawn through the aerosol substrate 134 when a user sucks on the aerosol generation device 100. The width and height (i.e. the distance that each thermal engagement element 120 extends along the heating chamber 108) increases the surface area of the side wall 114 that conveys heat to the air, allowing the aerosol generation device 100 to reach an effective temperature quicker. Furthermore, because the thermal engagement elements 120 extend into the interior volume to contact the substrate carrier 132, a plurality of air flow paths are defined between adjacent thermal engagement elements 120. As air enters the heating chamber 108 at the open end 110, it passes between the side wall 114 and the substrate carrier 134 and is forced between adjacent thermal engagement elements 120. The number and size of the thermal engagement elements 120 must be chosen to ensure that adequate air supply is provided in order to ensure sufficient and uniform heating and draw resistance. Four has been found to be a suitable number of thermal engagement elements 120 to provide sufficient uniform heating of the aerosol substrate 134 and to provide adequately-sized air flow channels.

It will be apparent that to conduct heat into the aerosol substrate 134, the surface of the thermal engagement elements 120 must reciprocally engage with the outer layer 142 of the substrate carrier 132. However, manufacturing tolerances may result in small variations in the diameter of the substrate carrier 132. In addition, due to the relatively soft and compressible nature of the outer layer 142 of the substrate carrier 132 and aerosol substrate 134 held therein, any damage to, or rough handling of, the substrate carrier 132 may result in the diameter being reduced or change shape to an oval or elliptical cross-section in the region which the outer layer 142 is intended to reciprocally engage with the surfaces of the thermal engagement elements 120. Accordingly, any variation in diameter of the substrate carrier 132 may result in reduced thermal engagement between the outer layer 142 of substrate carrier 132 and the surface of the thermal engagement elements 120 which detrimentally affects the conduction of heat from the thermal engagement elements 120 through the outer layer 142 of the substrate carrier 132 and into the aerosol substrate 134. To mitigate the effects of any variation in the diameter of the substrate carrier 132 due to manufacturing tolerances or damage, the thermal engagement elements 120 are preferably dimensioned to extend far enough into the heating chamber 108 to cause compression of the substrate carrier 132 and thereby ensure an interference fit between surface of the thermal engagement elements 120 and the outer layer 142 of the substrate carrier 132. This compression of the substrate carrier 132 may also cause longitudinal marking of the outer layer 142 of substrate carrier 132 and provide a visual indication that the substrate carrier 132 has been used. Furthermore, compression by the thermal engagement elements 120 may also reduce any variations in density of the aerosol substrate 134 and provide a more consistent and uniform distribution of aerosol substrate 134 across the width of the substrate carrier 132. This can provide more efficient and even heating.

Figure 8:
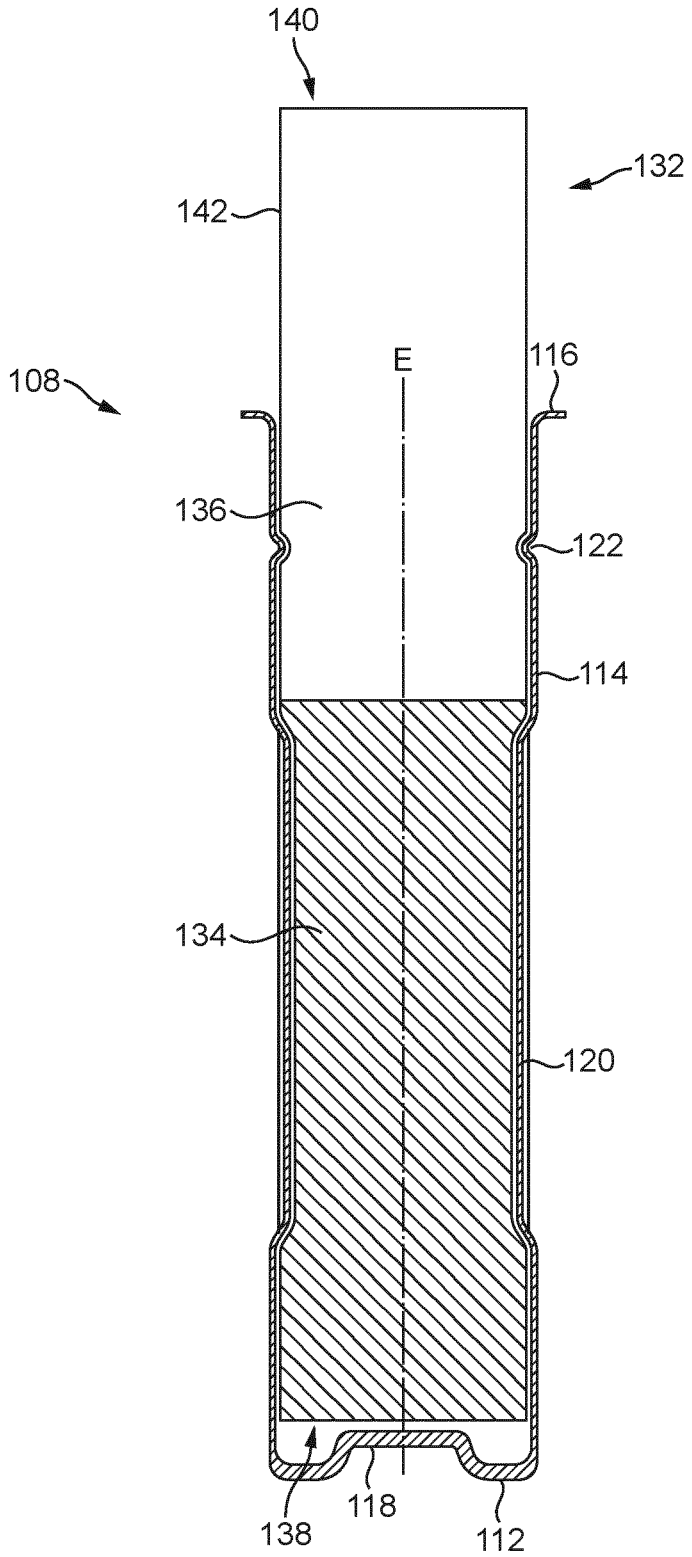
FIG. 8 is a schematic cross-sectional view from the side of the heating chamber of FIG. 5B, shown with a substrate carrier including aerosol substrate loaded into the heating chamber.

As the thermal engagement elements 120 are provided to conduct heat to the aerosol substrate 134, it is preferable that the thermal engagement elements 120 are aligned with the region of the substrate carrier 132 containing the aerosol substrate 134 when the substrate carrier 132 is inserted into the heating chamber 108. As shown in FIG. 8, the thermal engagement elements 120 are aligned with the aerosol substrate 134.

It is preferable to provide a number and arrangement of thermal engagement elements 120 to be evenly spaced apart such that the heating effect is evenly distributed. This has the added effect of providing a centring force towards the central axis E on the substrate carrier 132. For example, in this example the four thermal engagement elements 120, as well as providing the heating effects, also providing some centring effect to keep the substrate carrier 132 located centrally within the heating chamber 108. This can also improve the uniformity of air flow around the substrate carrier 132, further improving heating uniformity.

It has been found that as the aerosol substrate 134 is heated, the aerosol substrate 134 shrinks away from the thermal engagement elements 120 and the compression force to maintain the substrate carrier 132 in the heating chamber 108 and prevent it falling out is no longer optimal. Therefore, a plurality of gripping elements 122 are provided in accordance with the present disclosure, as will be described in greater detail below.

In this example, the inner diameter of the side wall 114 is 7.6 mm. As the heating chamber 108 is adapted for use with a substrate carrier 132 of diameter of 7.0 mm, this provides a clearance of around 0.3 mm either side of the substrate carrier 132 from the side wall 114. Each thermal engagement element 120 extends into the interior volume by around 0.6 mm, contacting and compressing the aerosol substrate 134 within the substrate carrier 132 by around 0.3 mm on either side.

In order to be confident that the thermal engagement elements 120 contact the substrate carrier 132 (contact being necessary to cause conductive heating, compression and deformation of the aerosol substrate), account is taken of the manufacturing tolerances of each of: the thermal engagement elements 120; the heating chamber 108; and the substrate carrier 132. For example, the internal diameter of the heating chamber 108 may be 7.6±0.1 mm, the substrate carrier 132 may have an external diameter of 7.0±0.1 mm and the thermal engagement elements 120 may have a manufacturing tolerance of ±0.1 mm. In this example, assuming that the substrate carrier 132 is mounted centrally in the heating chamber 108 (i.e. leaving a uniform gap around the outside of the substrate carrier 132), then gap which each thermal engagement element 120 must span to contact the substrate carrier 132 ranges from 0.2 mm to 0.4 mm. In other words, since each thermal engagement element 120 spans a radial distance, the lowest possible value for this example is half the difference between the smallest possible heating chamber 108 diameter and the largest possible substrate carrier 132 diameter, or [(7.6–0.1)–(7.0+0.1)]/2=0.2 mm. The upper end of the range for this example is (for similar reasons) half the difference between the largest possible heating chamber 108 diameter and the smallest possible substrate carrier 132 diameter, or [(7.6+0.1)–(7.0–0.1)]/2=0.4 mm. In order to ensure that the thermal engagement elements 120 definitely contact the substrate carrier 132, it is apparent that they must each extend at least 0.4 mm into the heating chamber 108 in this example. However, this does not account for the manufacturing tolerance of the thermal engagement elements 120 themselves. When a thermal engagement element 120 of 0.4 mm is desired, the range which is actually produced is 0.4±0.1 mm or varies between 0.3 mm and 0.5 mm. Some of these will not span the maximum possible gap between the heating chamber 108 and the substrate carrier 132. Therefore, the thermal engagement elements 120 of this example should be produced with a nominal protruding distance of 0.5 mm, resulting in a range of values between 0.4 mm and 0.6 mm. This is sufficient to ensure that the thermal engagement elements 120 will always contact the substrate carrier 132.

In general, writing the internal diameter of the heating chamber 108 as $H \pm \delta_H$, the external diameter of the substrate carrier 132 as $S \pm \delta_S$, and the distance which the thermal engagement elements 120 extend into the heating chamber 108 as $T \pm \delta_T$, then the distance which the thermal engagement elements 120 are intended to extend into the heating chamber 108 should be selected as:

$$T = \frac{(H + |\delta_H|) - (S - |\delta_S|)}{2} + |\delta_T|$$

where $|\delta_H|$ refers to the magnitude of the manufacturing tolerance of the internal diameter of the heating chamber 108, psi refers to the magnitude of the manufacturing tolerance of the external diameter of the substrate carrier 132 and $|\delta_T|$ refers to the magnitude of the manufacturing tolerance of the distance which the thermal engagement elements 120 extend into the heating chamber 108. For the avoidance of doubt, where the internal diameter of the heating chamber 108 is $H \pm \delta_H = 7.6 \pm 0.1$ mm, then $|\delta_H| = 0.1$ mm.

In some examples, an additional extension may be applied to ensure that the thermal engagement elements 122 not only contact the substrate carrier 132, but that they provide a degree of compression of the substrate carrier 132 to hold it securely and to retain contact even in cases where e.g. the aerosol substrate 134 contracts when heated, which may be represented by A in the following equation:

$$T = \frac{(H + |\delta_H|) - (S - |\delta_S|)}{2} + |\delta_T| + \Delta$$

It will be apparent that the addition of A may be suitably applied, and may in the above example correspond to a distance of around 0.1 mm. For example, to ensure a compression of at least 0.1 mm, the gripping elements 122 may be produced with a nominal depth of 0.6 mm, resulting in a range of 0.5 mm to 0.7 mm. It will be clear that this distance can be chosen to ensure the desired compression, and hence to ensure a contact by the thermal engagement elements even if the aerosol substrate shrinks when heated.

Furthermore, manufacturing tolerances may result in minor variations in the density of the aerosol substrate 134 within the substrate carrier 132. Such variances in the density of the aerosol substrate 134 may exist both axially and radially within a single substrate carrier 132, or between different substrate carriers 132 manufactured in the same batch. Accordingly, it will also be apparent that to ensure relatively uniform conduction of heat within the aerosol substrate 134 within a particular substrate carrier 132 it is important to ensure that the density of the aerosol substrate 134 is also relatively consistent. To mitigate the effects of any inconsistencies in the density of the aerosol substrate 134, the thermal engagement elements 120 may be dimensioned to extend far enough into the heating chamber 108 to cause compression of the aerosol substrate 134 within the substrate carrier 132, which can improve thermal conduction through the aerosol substrate 134 by eliminating air gaps. In the illustrated example, thermal engagement elements 120 extending about 0.4 mm into the heating chamber 108 are appropriate. In other examples, the distance which the thermal engagement elements 120 extend into the heating chamber 108 may be defined as a percentage of the distance across the heating chamber 108. For example, the thermal engagement elements 120 may extend a distance between 3% and 7%, for example about 5% of the distance across the heating chamber 108.

In relation to the thermal engagement elements 120, the width corresponds to the distance around the perimeter of the side wall 126. Similarly, their length direction runs transverse to this, running broadly from the base 112 to the open end of the heating chamber 108, or to the flange 138, and their depth corresponds to the distance that the thermal engagement elements 120 extend from the side wall 126. It will be noted that the space between adjacent thermal engagement elements 120, the side wall 126, and the outer layer 142 of the substrate carrier 132 defines the area available for air flow. This has the effect that the smaller the distance between adjacent thermal engagement elements 120 and/or the depth of the thermal engagement elements 120 (i.e. the distance which the thermal engagement elements 120 extend into the heating chamber 108), the harder that a user has to suck to draw air through the aerosol generation device 100 (known as increased draw resistance). It will be apparent that (assuming the thermal engagement elements 120 are touching the outer layer 142 of the substrate carrier 132) that it is the width of the thermal engagement elements 120 which defines the reduction in air flow channel between the side wall 114 and the substrate carrier 132.

Conversely (again under the assumption that the thermal engagement elements 120 are touching the outer layer 142 of the substrate carrier 132), increasing the length of the thermal engagement elements 120 results in more compression of the aerosol substrate 134, which eliminates air gaps in the aerosol substrate 134 and also increases draw resistance.

These two parameters can be adjusted to give a satisfying draw resistance, which is neither too low nor too high. The heating chamber 108 can also be made larger to increase the air flow channel between the side wall 114 and the substrate carrier 132, but there is a practical limit on this before the heat generator 130 starts to become ineffective as the gap is too large. Typically a gap of 0.2 mm to 0.3 mm around the outer surface of the substrate carrier 132 is a good compromise, which allows fine tuning of the draw resistance within acceptable values by altering the dimensions of the thermal engagement elements 120.

The air gap around the outside of the substrate carrier 132 can also be altered by changing the number of thermal engagement elements 120. Any number of thermal engagement elements 120 (from one upwards) provides at least some of the advantages set out herein (increasing heating area, providing compression, providing conductive heating of the aerosol substrate 134, adjusting the air gap, etc.). Four is the lowest number that reliably holds the substrate carrier 132 in a central (i.e. coaxial) alignment with the heating chamber 108. Designs with fewer than four thermal engagement elements 120 tend to allow a situation where the substrate carrier 132 is pressed against a portion of the side wall 114 between two of the thermal engagement elements 120. Clearly with limited space, providing very large numbers of thermal engagement elements 120 (e.g. thirty or more) tends towards a situation in which there is little or no gap between them, which can completely close the air flow path between the outer surface of the substrate carrier 132 and the inner surface of the side wall 114, greatly reducing the ability of the aerosol generation device 100 to provide convective heating. In conjunction with the possibility of providing a hole in the centre of the base 112 for defining an air flow channel, such designs can still be used, however. Usually the thermal engagement elements 120 are evenly spaced around the perimeter of the side wall 126, which can help to provide even compression and heating, although some variants may have an asymmetric placement, depending on the exact effect desired.

It will be apparent that the size and number of the thermal engagement elements 120 also allows the balance between conductive and convective heating to be adjusted. By increasing the width of a thermal engagement element 120 which contacts the substrate carrier 132 (distance which a thermal engagement element 120 extends around the perimeter of the side wall 114), the available perimeter of the side wall 114 to act as an air flow channel is reduced, so reducing the convective heating provided by the aerosol generation device 100. However, since a wider thermal engagement element 120 contacts the substrate carrier 132 over a greater portion of the perimeter, this increases the conductive heating provided by the aerosol generation device 100. A similar effect is seen if more thermal engagement elements 120 are added, in that the available perimeter of the side wall 114 for convection is reduced while increasing the conductive channel by increasing the total contact surface area between the thermal engagement element 120 and the substrate carrier 132. Note that increasing the length of a thermal engagement element 120 also decreases the volume of air in the heating chamber 108 which is heated by the heat generator 130 and reduces the convective heating, while increasing the contact surface area between the thermal engagement element 120 and the substrate carrier 132 and increasing the conductive heating. Increasing the distance which each thermal engagement element 120 extends into the heating chamber 108 can help to improve the conductive heating without significantly reducing convective heating.

Therefore, the aerosol generation device 100 can be designed to balance the conductive and convective heating types by altering the number and size of thermal engagement elements 120, as described above. The heat localisation effect due to the relatively thin side wall 114 and the use of a relatively low thermal conductivity material (e.g. stainless steel) ensures that conductive heating is an appropriate means of transferring heat to the substrate carrier 132 and subsequently to the aerosol substrate 134 because the portions of the side wall 114 which are heated can correspond broadly to the locations of the thermal engagement elements 120, meaning that the heat generated is conducted to the substrate carrier 132 by the thermal engagement elements 120, but is not conducted away from here. In locations which are heated but do not correspond to the thermal engagement elements 120, the heating of the side wall 114 leads to the convective heating.

In this example, the thermal engagement elements 120 are elongate, which is to say they extend for a greater length than their width. In some cases the thermal engagement elements 120 may have a length which is five, ten or even twenty-five times their width. For example, as noted above, the thermal engagement elements 120 may extend 0.4 mm into the heating chamber 108, and may further be 0.5 mm wide and 12 mm long in one example. These dimensions are suitable for a heating chamber 108 of length between 30 mm and 40 mm, preferably 31 mm. The thermal engagement elements 120 do not extend for the full length of the heating chamber 108, and have a length less than the length of the side wall 114. The thermal engagement elements 120 therefore each have a top edge and a bottom edge. The top edge is the part of the thermal engagement element 120 located closest to the open end 110 of the heating chamber 108, and also closest to the flange 116. The bottom edge is the end of the thermal engagement element 120 located closest to the base 112. Above the top edge (closer to the open end than the top edge) and below the bottom edge (closer to the base 112 than the bottom edge) it can be seen that the side wall 114 has no thermal engagement elements 120. In some examples, the thermal engagement elements 120 are longer and do extend all the way to the bottom of the side wall 114 adjacent the base 112. Indeed in such cases, there may not even be a bottom edge. The thermal engagement elements 120 do not extend to the open end 110 and are spaced away from the open end 110. Between the thermal engagement elements 120 and the open end 110 are positioned a plurality of gripping elements 122 as will be described in greater detail below. Preferably, there are no indentations between the thermal engagement elements 120 and the gripping elements 122, as shown in FIG. 5B.

At the upper end the top edge of the thermal engagement element 120 can be used as an indicator for a user to ensure that they do not insert the substrate carrier 132 too far into the aerosol generation device 100. Similarly, compression of the aerosol substrate 134 at the first end 138 of the substrate carrier 132 that is inserted into the heating chamber 108 can lead to some of the aerosol substrate 134 falling out of the substrate carrier 132 and dirtying the heating chamber 108. It can therefore be advantageous to have the lower edge of the thermal engagement elements 120 located further from the base 112 than the expected position of the first end 138 of the substrate carrier 132.

In some examples, the thermal engagement elements 120 are not elongate, and have approximately the same width as their length. For example they may be as wide as they are high (e.g. having a square or circular profile when looked at in a radial direction), or they may be two to five times as long as they are wide. Note that the centring effect that the thermal engagement elements 120 provide can be achieved even when the thermal engagement elements 120 are not elongate. However, to achieve the thermal engagement functionality desired herein, it is preferable that the thermal engagement elements 120 provide a large surface area in contact with the substrate carrier 132 to promote heat transfer. This is provided optimally by forming the thermal engagement elements 120 in an elongate shape.

Figure 5B:
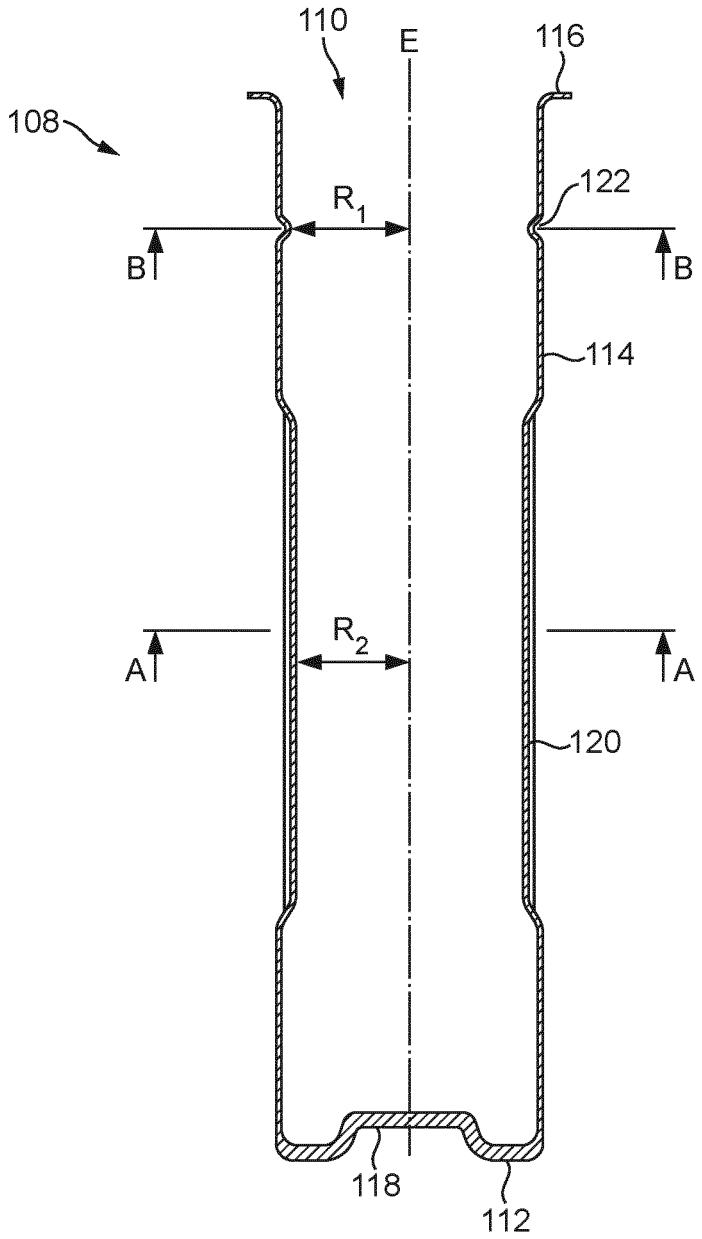
FIG. 5B is a schematic cross-sectional view from the side of a heating chamber according to the disclosure.

In side view, as shown in FIG. 5B, the thermal engagement elements 120 are shown as having a trapezoidal profile. That is to say that the upper edge is broadly planar and tapers to merge with the side wall 114 towards the open end 110 of the heating chamber 108. In other words, the upper edge is a bevelled shape in profile. Similarly, the lower edge that is broadly planar and tapers to merge with the side wall 114 close to the base 112 of the heating chamber 108. That is to say, the lower edge is a bevelled shape in profile. In other examples, the upper and/or lower edges do not taper towards the side wall 114 but instead extend at an angle of approximately 90° from the side wall 114. In yet other examples, the upper and/or lower edges have a curved or rounded shape. Bridging the upper and lower edges is a broadly planar region which contacts and/or compresses the substrate carrier 132. A planar contacting portion can help to provide even compression and conductive heating. In other examples, the planar portion may instead be a curved portion which bows outwards to contact the substrate carrier, for example having a polygonal or curved profile (e.g. a section of a circle).

The upper edge of the thermal engagement elements 120 can act to prevent over-insertion of a substrate carrier 132. As shown most clearly in FIG. 4, the substrate carrier 132 has a lower part containing the aerosol substrate 134, which ends part way along the substrate carrier 132. The aerosol substrate 134 is typically more compressible than other regions of the substrate carrier 132 such as the aerosol collection region 136. Therefore, a user inserting the substrate carrier 132 feels an increase in resistance when the upper edge of the thermal engagement elements 120 is aligned with the boundary of the aerosol substrate 134, due to the reduced compressibility of other regions of the substrate carrier 132. In order to achieve this, the platform 118 of the base 112 which the substrate carrier 132 contacts should be spaced away from the top edge of the thermal engagement element 120 by the same distance as the length of the substrate carrier 132 occupied by the aerosol substrate 134. In some examples, the aerosol substrate 134 occupies around 20 mm of the substrate carrier 132, so the spacing between the top edge of the thermal engagement element 120 and the parts of the base which the substrate carrier 132 touches when it is inserted into the heating chamber 108 is also about 20 mm. The upper edge may be sloped to aid insertion and prevent damage to the substrate carrier 132 as it is inserted and prevent tearing of the outer layer 142 which is typically made from paper.

The heating chamber 108 comprises a plurality of gripping elements 122. The gripping elements 122 are formed on the inner surface of the side wall 114. The gripping elements 122 extend inwardly from the inner surface of the side wall 114 into the interior volume of the heating chamber 108 towards the central axis E. The gripping elements 122 are arranged to grip the substrate carrier 132 when the substrate carrier 132 is inserted into the heating chamber 108.

The gripping elements 122 perform a different function to the thermal engagement elements 120. While the thermal engagement elements 120 contact the substrate carrier 132 to conduct heat to the aerosol substrate 134, the gripping elements 122 are provided to grip the substrate carrier 132 and are dimensioned and shaped to reduce the thermal transfer effect to the substrate carrier.

The gripping elements 122 extend into the heating chamber 108 sufficiently to make contact with, and to preferably grip, the substrate carrier 132 when inserted into the heating chamber 108. As mentioned above, the thermal engagement elements 120 extend into the interior volume to compress the substrate carrier 132 at the region containing the aerosol substrate 134. This provides good thermal contact for conducting heat from the heat generator 130 into the aerosol substrate 134. However, the inventors have found that as the aerosol substrate 134 is heated, the aerosol substrate 134 tends to shrink within the substrate carrier 132. In particular, the aerosol substrate 134 shrinks away from the side wall 114 and effectively reduces its diameter. This can make the contact with the thermal engagement elements 120 less consistent and less secure. Initially, the thermal engagement elements 120 can be arranged to extend into the interior volume and compress the aerosol substrate 134 to maintain sufficient contact to promote heat transfer. However, shrinkage of the aerosol substrate 134 may reduce the effectiveness of that engagement such that the substrate carrier 132 is not held in place optimally. For example, if the aerosol generation device 100 is held upside-down or if the substrate carrier sticks on lips of the user, this could allow the substrate carrier 132 to be removed unintentionally, or the aerosol substrate 134 to become misaligned with the heating components.

Providing the thermal engagement elements 120 extending further into the interior volume to compensate for this is not preferable as it further restricts air flow into the heating chamber 108, and also presents a reduced area for inserting the substrate carrier 132 before heating and shrinkage. It is therefore preferable to impose a limit on the extension of the thermal engagement elements 122 into the interior volume of the heating chamber 108 to ensure the air flow is not restricted. Moreover, when the substrate carrier 132 is inserted in this configuration, the aerosol substrate 134 will be compressed to the reduced diameter set by the extended thermal engagement elements 120 and will once again shrink further once heated. Over-compression of the aerosol substrate 134 should be avoided to allow air flow through the aerosol substrate 134.

It has been found that by providing a plurality of separate gripping elements 122 in accordance with the present disclosure, the substrate carrier 132 can be held securely in place independently from the thermal engagement elements 120. In particular, the gripping elements 122 provide additional gripping without impeding the air flow. As described below, this effect is particularly realised when the gripping elements 122 are arranged to overlap with regions of the substrate carrier 132 which are heat stable and do not contract as the substrate carrier 132 is heated. The exact location of the gripping elements 122 in the heating chamber 108 is not critical, so long as they align with the portions of the substrate carrier 132 which are heat stable and do not contract, for example the aerosol collection region 136.

In this example, the side wall 114 has a length of 31 mm. The gripping elements 122 are spaced away from the open end 110 of the heating chamber 108 by a distance of 4 mm along the length of the side wall 114. The gripping elements 122 are spaced away from the thermal engagement elements 120 by around 5 mm. Due to the thin side wall 114 and the small contact area of the gripping elements, thermal transfer along the side wall 114 is restricted, meaning that little heat is transferred to the gripping elements 122 towards the open end 110. This reduces heat transfer by the gripping elements 122, which are typically in contact with portions of the substrate carrier 132 not including aerosol substrate 134, reducing undesirable heating of the gripping elements 122.

The gripping elements 122 have a length parallel to the length of the side wall 114, broadly in the direction from the base 112 to the open end 110 of the heating chamber 108. The gripping elements 122 have a width around the perimeter of the side wall 114. The gripping elements 122 have a depth which is the extent to which they extend radially inwards into the interior volume of the heating chamber 108.

The gripping elements 122 extend into the interior volume of the heating chamber 108. The gripping elements 122 extend into the interior volume less than thermal engagement elements 120 do. This is to adapt to the difference of rigidity of the substrate carrier in the different regions these elements press.

It can be seen from FIG. 5B that the innermost portion of each thermal engagement element 120 is located a radial distance $R_2$ from the central axis E. Similarly, each gripping element 122 is located a radial distance $R_1$ from the central axis E. In this example, the gripping elements 122 extend into the interior volume by a shorter radial distance than the thermal engagement elements 120. In other words $R_1>R_2$.

Another way to look at this is to consider the circumference (that is, perimeter in a plane perpendicular to the central axis E) of the heating chamber 108. The circumference of the heating chamber 108 in regions where there are no gripping elements 122 or thermal engagement elements 120 serves as a baseline circumference. The baseline circumference has a characteristic dimension, referred to herein as a diameter, which is the shortest distance across the heating chamber 108 running through the central axis E. For cylindrical heating chambers 108, the circumference is a circle and the diameter has the usual meaning in relation to circles. For heating chambers 108 having an elliptical cross-section, the diameter is twice the semi-minor axis. For heating chambers 108 having a square or rectangular cross-section, the diameter is the distance across the heating chamber 108 perpendicular to the side wall 114 between opposing (longest) sides. Other shapes are possible and have definitions of circumferences and diameters consistent with this description.

Where the side wall 114 has been deformed inwards to create gripping elements 122 or thermal engagement elements 120, the circumference around the wall is no longer a simple shape and also becomes longer in general due to the curvature introduced by the deformation. However, a first restriction circumference can be defined as the largest similar shape (that is the same shape and orientation, but differing in size) to the baseline circumference which can fit into the heating chamber 108 along the length in a region aligned with the gripping elements 122 so that the first restriction circumference just touches the innermost portions of the gripping elements 122. Such a first restriction circumference is shown as a dashed line in FIG. 6B. Similarly, a second restriction circumference can be defined as the largest similar shape (that is the same shape and orientation, but differing in size) to the baseline circumference which can fit into the heating chamber 108 along the length in a region aligned with the thermal engagement elements 120 so that the second restriction circumference just touches the innermost portions of the thermal engagement elements 120. Such a second restriction circumference is shown as a dashed line in FIG. 6C.

The first and second restriction circumferences have corresponding first and second restriction diameters, defined analogously to the diameter for the baseline circumferences set out above. Thus a cylindrical heating chamber 108 has circular first and second restriction circumferences and first and second restriction diameters having the usual meaning in relation to circles. For heating chambers 108 having an elliptical cross-section, the first and second restriction diameters will also be elliptical (with the same degree of eccentricity) and the first and second restriction diameters are the diameter of twice the semi-minor axis of their respective ellipses. For heating chambers 108 having a square or rectangular cross-section, each restriction circumference is also (respectively) a square or rectangle of the same relative side lengths and orientation. The first and second restriction diameters are the distance across the heating chamber 108 perpendicular to the side wall 114 between opposing (longest) sides for their respective restriction circumferences. Other shapes can be seen to conform to this general pattern.

Figure 6A:
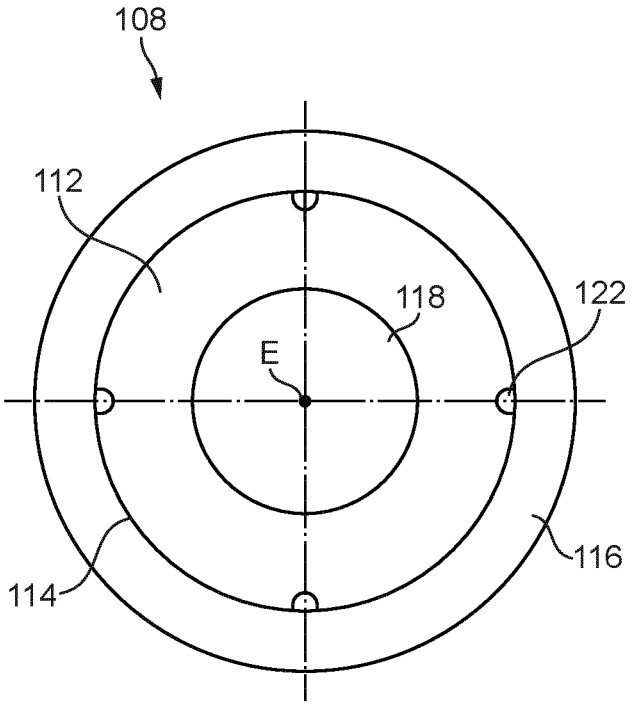
FIG. 6A is a schematic plan view from above of the heating chamber of FIG. 5B.
Figure 6B:
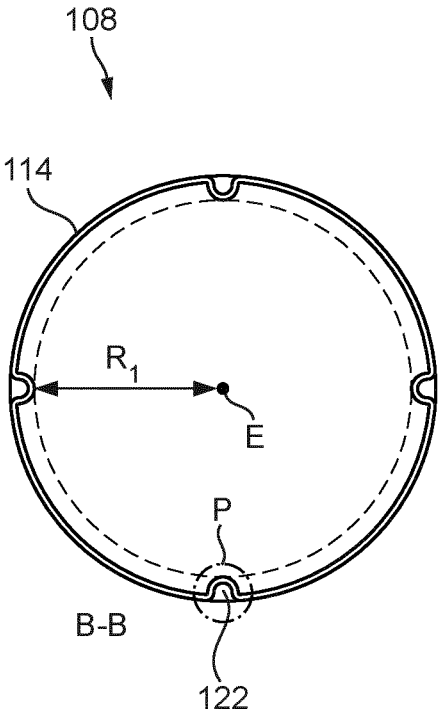
FIG. 6B is a cross-sectional view in plane B-B of the heating chamber of FIG. 5B.
Figure 6C:
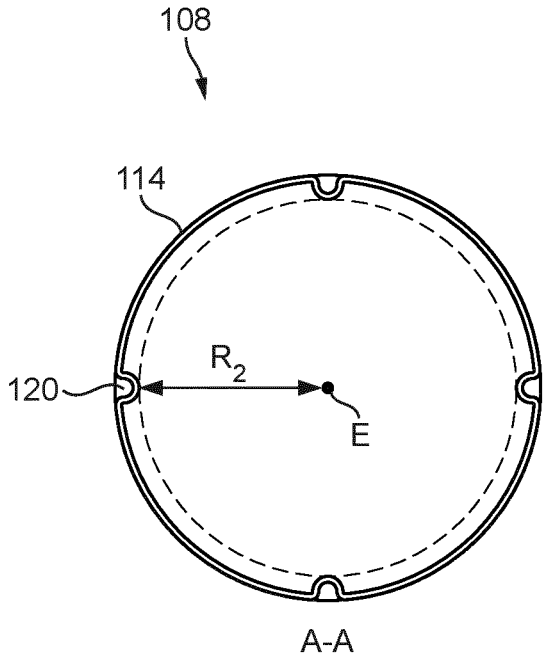
FIG. 6C is a cross-sectional view in plane A-A of the heating chamber of FIG. 5B.

An example is shown in FIGS. 5B, 6B and 6C, in which the baseline diameter is simply the distance across the heating chamber 108, e.g. below the thermal engagement elements 120 (or between the thermal engagement elements 120 and the gripping elements 122). The radial distance $R_1$ between the central axis E and the innermost portion of the gripping elements 122 is seen to correspond to half of the first restriction diameter. In other words the first restriction diameter is $2\times R_1$. Similarly, the radial distance $R_2$ between the central axis E and the innermost portion of the thermal engagement elements 122 is seen to correspond to half of the second restriction diameter. In other words the second restriction diameter is $2\times R_2$.

As the heating chamber 108 is cylindrical in this example, the baseline circumference and the first and second restriction circumferences are all circles. These latter two circles have radii of $R_1$ and $R_2$ respectively. As discussed above the thermal engagement elements 120 extend further into the interior volume of the heating chamber 108 than the gripping elements 122. This means that the first restriction diameter is larger than the second restriction diameter. In other words, the first restriction circumference is a circle larger (longer perimeter and enclosing a larger area) than the circle of the second restriction circumference. It will be seen that these observations remain true for tubular heating chambers 108 of a variety of cross-sectional shapes, in which the gripping elements 122 extend less far into the interior volume of the heating chamber 108 than the thermal engagement elements 120.

Ideally the thermal engagement elements 120 extend about 0.1 mm to 0.2 mm further into the interior volume of the heating chamber 108 than the gripping elements 122. Another way of looking at this is that the first restriction diameter may be 64 mm, while the substrate carrier 132 has an outer diameter of 70 mm so the gripping elements 122 compress the substrate carrier by 3 mm on each side. By contrast, the second restriction diameter may be 62 mm for a 70 mm substrate carrier 132 outer diameter, giving a compression of 4 mm on each side by the thermal engagement elements. This increased compression can help retain contact between the thermal engagement elements 120 and the outer surface of the substrate carrier 132 in the cases that the aerosol substrate 134 shrinks when it is heated.

This means that the gripping elements 122 do not restrict the cross section of the heating chamber 108 and thus the air flow by any more than the thermal engagement elements 120. In some cases, the profile of the gripping elements 122 which block part of the interior volume in a plane perpendicular to the length of the side wall 114 is equal to the profile of the thermal engagement elements 120. In other words, each gripping element 122 has an innermost portion for contacting the substrate carrier 132, and the innermost portions are all located the same radial distance from the central axis E of the heating chamber 108.

As the gripping elements 122 are preferably arranged to align with a component of the substrate carrier 132 that is not aerosol substrate 134, such as the aerosol collection region 136 in the form of a cardboard tube, the gripping elements 122 are in contact with a component that is more solid and less compressible than the aerosol substrate 134 and which does not shrink during heating. Therefore, better contact can be maintained, and the gripping elements 122 need not extend as far into the interior volume as the thermal engagement elements 120. In some examples, the aerosol collection region 136 may comprise a suitable notch for engaging with the gripping elements 122 to help a user locate the substrate carrier 132 within the heating chamber 108, for example by clicking into place.

Using the above example of a substrate carrier 132 having a diameter of 7.0 mm and an inner diameter of the side wall of 7.6 mm, the clearance to the side wall 114 is around 0.3 mm on either side of the substrate carrier 132. To contact the substrate carrier 132, the depth of the gripping elements 122 is chosen to be at least 0.3 mm. That is, the gripping elements 122 extend into the interior volume towards the central axis E by at least 0.3 mm.

As with the thermal engagement elements 120, account of the manufacturing tolerances should be taken. For example, the internal diameter of the heating chamber 108 may be 7.6±0.1 mm, the substrate carrier 132 may have an external diameter of 7.0±0.1 mm and the thermal engagement elements 120 may have a manufacturing tolerance of ±0.1 mm. In the same way as above, the lowest value for the depth of the gripping elements 122 is 0.2 mm, and the highest is 0.4 mm. Therefore, the depth of the gripping elements 122 must be at least 0.4 mm to guarantee contact when considering the variation in the heating chamber 108 and the substrate carrier 132. When considering the tolerance of the gripping elements 122 themselves, the range is 0.4 mm±0.1 mm (i.e. 0.3 mm to 0.5 mm). To ensure contact, the gripping elements 122 must be produced with a nominal depth of 0.5 mm, resulting in a range of values between 0.4 mm and 0.6 mm.

This is sufficient to ensure that the gripping elements 122 will always contact the substrate carrier 132.

As above, writing the internal diameter of the heating chamber 108 as $H \pm \delta_H$, the external diameter of the substrate carrier 132 as $S \pm \delta_S$, and the distance which the gripping elements 122 extend into the heating chamber 108 as $G \pm O_G$, then the distance which the gripping elements 122 are intended to extend into the heating chamber 108 should be selected as:

$$G = \frac{(H + |\delta_H|) - (S - |\delta_S|)}{2} + |\delta_G|$$

where $|\delta_H|$ refers to the magnitude of the manufacturing tolerance of the internal diameter of the heating chamber 108, $|\delta_S|$ refers to the magnitude of the manufacturing tolerance of the external diameter of the substrate carrier 132 and $|\delta_G|$ refers to the magnitude of the manufacturing tolerance of the distance which the gripping elements 122 extend into the heating chamber 108. For the avoidance of doubt, where the internal diameter of the heating chamber 108 is $H \pm \delta_H = 7.6 \pm 0.1$ mm, then $|\delta_H| = 0.1$ mm.

The gripping elements 122 have a length extending along the length of the side wall 114 of less than 5 mm, preferably less than 3 mm, more preferably less than 2 mm, still more preferably less than 1 mm. Compared to the length of the side wall 114, the length of the gripping elements 122 is preferably less than 20% of the length of the side wall 114, more preferably less than 10%, still more preferably less than 5%. In general, the gripping elements 122 are arranged to grip, but not to transfer heat to parts of the substrate carrier 132 which need not be heated. This is best achieved with smaller gripping elements, to minimise contact surface area.

Figure 6D:
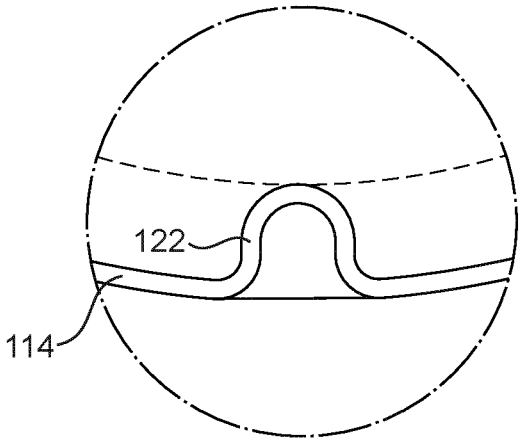
FIG. 6D is a detail of the view of portion P of FIG. 6B showing a gripping element of the heating chamber.
Figure 7:
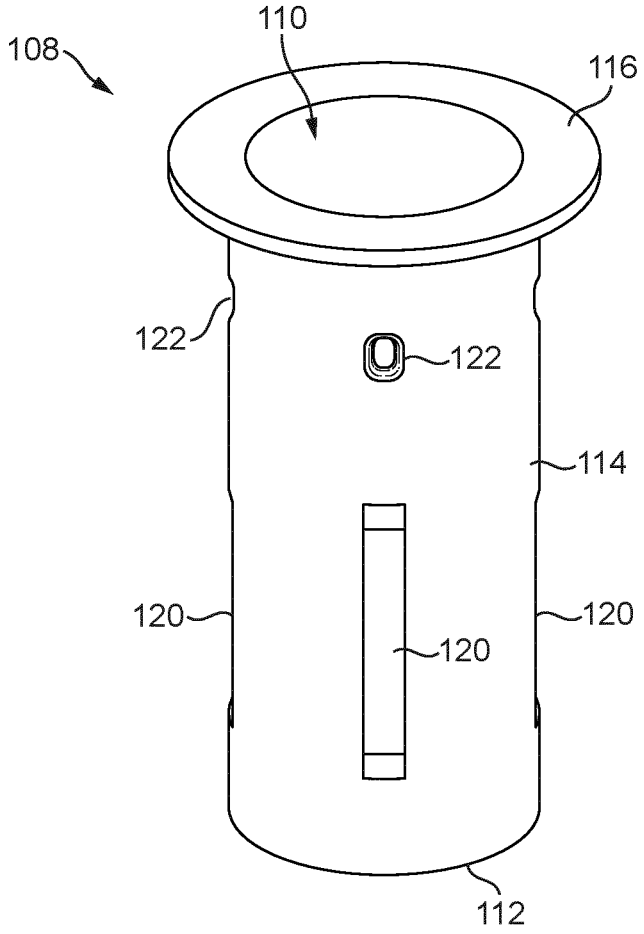
FIG. 7 is a perspective view of the heating chamber of FIG. 5B.

The gripping elements 122 may be formed as embossed dimples formed in the outer wall of the heating chamber 108. FIG. 6D shows a detailed view of such a gripping element 122 highlighted as the portion P in FIG. 6B. This design provides a limited heat transfer but a firm gripping action. The gripping elements 122 may a curved innermost portion joining the side wall at a circumference which is substantially circular, elliptical, square or rectangular. The tip (innermost interior portion) of the gripping element is preferably rounded or flat to avoid tearing the surface of the substrate carrier (e.g. tipping paper). For example, the dimple 122 may form a profile which is partially elliptical, a hemi-spherical or trapezoidal in a plane parallel to the length of the heating chamber at its innermost portion. The dimples 122 are formed in the outer surface of the heating chamber, and may have a cavity comprising a substantially hemispherical innermost portion and an annular outermost portion joining the tubular side wall. The annular outermost portion may connect to the side wall by a slight curved portion e.g. having a radius of around 0.1 mm. For example, the diameter of the outermost portion may be between 0.3 and 1 mm, preferably between 0.4 and 0.7 mm, for example 0.6 mm and the radius of the spherical innermost portion may be, for instance, about 0.15 mm.

The thermal engagement elements 120 have a length greater than the length of the gripping elements 122. In particular, the thermal engagement elements 120 have a length which is at least twice as large as the length of the gripping elements 122, preferably at least three times as large, more preferably at least five times as large, still more preferably at least ten times as large. It is preferable for the thermal engagement elements 120 to be longer to have a longer surface in contact with the aerosol substrate 134 for promoting thermal transfer to the aerosol substrate 134, and it is preferable to reduce the surface of the gripping elements 122 in contact with the substrate carrier 132 to reduce thermal transfer to regions not comprising aerosol substrate 134.

Referring to FIGS. 5B, 6A and 6B, the gripping elements 122 are arranged around the perimeter of the side wall 114. The plurality of gripping elements 122 are arranged such that individual gripping elements 122 are located around the perimeter of the side wall 114 at different locations. Referring to FIGS. 6A and 6B, four gripping elements 122 are shown, although other suitable numbers of gripping elements 122 are envisaged. The four gripping elements 122 are equally spaced around the perimeter of the side wall 114. This allows the substrate carrier 132 to be held securely within the heating chamber 108 by the gripping elements 122. Providing the gripping elements 122 equally spaced apart can also help centre the substrate carrier 132 within the heating chamber 108, especially when the gripping elements 122 are the same size and shape as each other. Similarly to the centring effect of the thermal engagement elements 120, four gripping elements 122 is the lowest number that reliably holds the substrate carrier 132 in a central (i.e. coaxial) alignment with the heating chamber 108. Designs with fewer than four gripping elements 122 tend to allow a situation where the substrate carrier 132 is pressed against a portion of the side wall 114 between two adjacent gripping elements 122, and this may press the substrate carrier 132 towards some of the thermal engagement elements 120 and away from others, causing non-uniform heating and non-uniform air flow paths. In other cases, it may be sufficient to provide two gripping elements 122 but this relies on a degree of contact from the thermal engagement elements 120 to aid in supporting the substrate carrier 132 in position.

The gripping elements 122 each extend part way along the inner perimeter of the side wall 114. In this example, as the side wall 114 is circular, the gripping elements 122 each extend part way along the inner circumference of the side wall 114. Referring to FIGS. 6A and 6B, each gripping element 122 extends only a small section around the side wall 114. In particular, each gripping element 122 extends around 1 mm around the circumference of the side wall 114. In this example, for an inner diameter of the heating chamber 108 of 7.6 mm, the four gripping elements 122 overlap 4 mm in total along the 23.9 mm circumference. Preferably, the total proportion of the perimeter covered by the gripping elements 122 is no more than 20%, more preferably no more than 10%. This prevents the gripping elements 122 from excessively restricting the air flow into the heating chamber 108 between the substrate carrier 132 and the side wall 114. In some examples, the gripping elements 122 have approximately the same length as their height. In any case the circumferential extent of the gripping elements 122 should not be larger than the circumferential extent of the thermal engagement elements 120 so that the gripping elements 122 do not restrict the air flow any more than it is already restricted by the thermal engagement elements 120. For this reason the gripping elements 122 are preferably angularly aligned with the thermal engagement elements 120 and of the same width.

Preferably, the gripping elements 122 are evenly spaced around the perimeter of the side wall 114, which can position the substrate carrier 132 centrally within the heating chamber 108 and allow air flow paths evenly around the substrate carrier 132.

In this example, the gripping elements 122 are aligned with the thermal engagement elements 120 along the length of the side wall 114. The gripping elements 122 are arranged at a position aligned with the thermal engagement elements 120 but are spaced away from the thermal engagement elements 120 along the length of the side wall 114. The gripping elements 122 extend into the interior volume by no more than the thermal engagement elements 120. Additionally, the gripping elements 122 extend around the perimeter by no more than the thermal engagement elements 120. This means that the gripping elements 122 do not protrude further into the interior volume than the thermal engagement elements 120, and do not interfere with air flow into the heating chamber 108.

Figure 10:
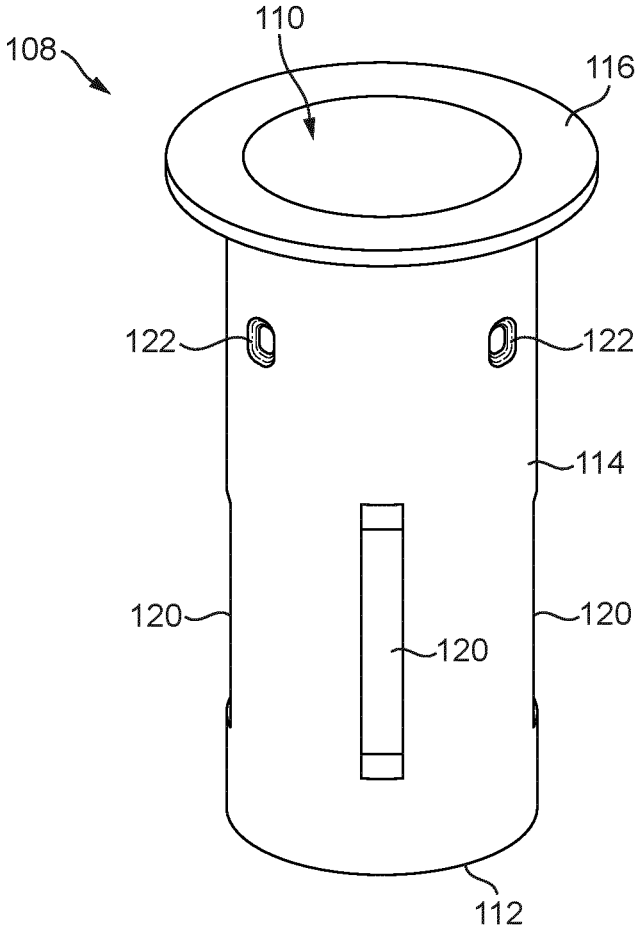
FIG. 10 is a perspective view of an alternative heating chamber according to the disclosure, with the gripping elements not aligned with the thermal engagement elements.

In alternative examples, such as shown in FIG. 10, the gripping elements 122 may not be aligned with the thermal engagement elements 120 along the length of the side wall 114 to force air flow past the thermal engagement elements 120.

However, in some examples it is preferable to have different profiles to tailor each set of elements to their specific functions. For example, in this example the gripping elements 122 have a rounded profile in a plane perpendicular to the length of the side wall 114 to grip the substrate carrier 132, while the thermal engagement elements 120 have a trapezoid shape with a flattened surface facing innermost towards the central axis E in the interior volume to present a larger surface area for contacting the substrate carrier 132.

The gripping elements 122 have a convex profile in a cross section perpendicular to the length of the side wall 114. In other words, the gripping elements 122 extend from the side wall 114 and into the interior volume to reduce the effective cross sectional area of the heating chamber 108.

Broadly, the gripping elements 122 have a reduced area portion towards the interior volume of the heating chamber 108. That is, the gripping elements 122 narrow from the side wall 114 towards the interior volume, towards the central axis E. In this example, the gripping elements 122 have a generally round cross section in a plane perpendicular to the length of the side wall 114. As shown in FIGS. 6A and 6B, the gripping elements 122 have a rounded profile extending from the side wall 114. Furthermore, in this example the gripping elements 122 have a generally round cross section in a plane parallel to the length of the side wall 114, as shown in FIG. 5B. That is, the gripping elements 122 of this example form a portion of a sphere, and in particular are hemispherical extending from the side wall 114. In this case, the gripping elements 122 extend substantially the same distance into the interior volume of the heating chamber 108 as their length along the length of the side wall 114 and the same distance as their width around the perimeter of the side wall 114. It will be appreciated that other shapes are possible, and the length need not be the same as the width, and neither the length nor the width need be the same as the depth.

Figure 12:
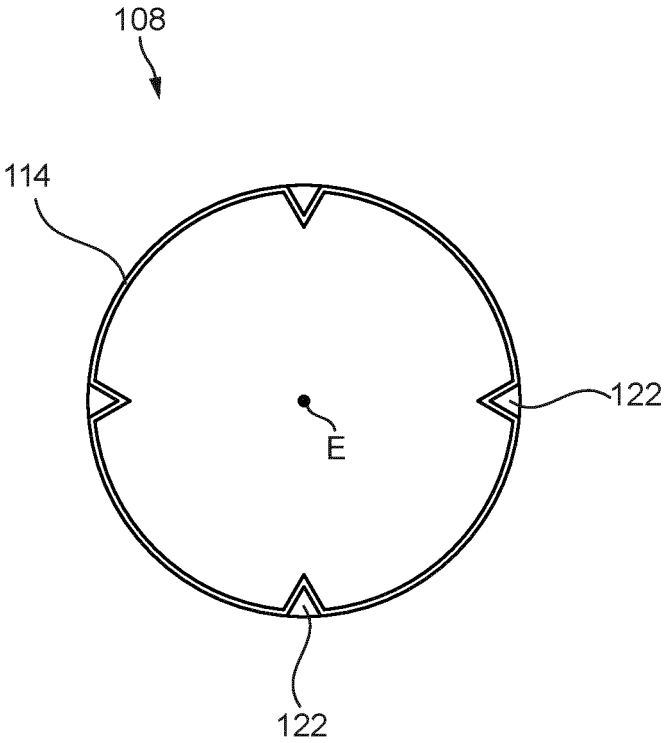
FIG. 12 is a schematic cross-sectional view through the gripping elements in a further alternative heating chamber according to the disclosure, in which the gripping elements have a triangular transverse profile.

This spherical shape provides the necessary extension into the interior volume to grip the substrate carrier 132, but reduces the area towards the interior volume to ensure that an excessive surface area is not presented, reducing the potential for any unwanted thermal transfer to the substrate carrier 132. As such, it is preferable that the gripping elements 122 have a rounded edge at the innermost point of the gripping elements 122 (the innermost point being the portion of the gripping elements 122 facing the interior volume and configured to contact the substrate carrier 132). In alternative examples, the gripping elements 122 may have a pointed edge to reduce contact area further and provide more of a pinching effect, such as shown in FIG. 12.

The gripping elements 122 provide an upper surface facing the open end 110 which slopes from the side wall 114 towards the central axis E. In other words, the gripping elements 122 taper towards the interior volume from the side wall 114 closest to the open end 110. This means that the gripping elements 122 effectively reduce the diameter of the side wall 114 along a direction from the open end 110 towards the base 112. This provides a slope that the substrate carrier 132 contacts first within the heating chamber 108 and can make it easier for a user to insert the substrate carrier 132 and prevent damage or tearing of the substrate carrier 132. In this example, the slope is provided by the spherical surface of the gripping elements 122. It will be appreciated that the slope can be provided with other shapes such as triangular, trapezoid, or other sloping or rounded shapes.

The gripping elements 122 can also be used to help a user locate the substrate carrier 132 within the heating chamber 108. Considering the example shown in FIG. 8, where the boundary of the aerosol substrate 134 and the aerosol collection region 136 aligns with the upper edge of the thermal engagement elements 120, when a user inserts the substrate carrier 132, the aerosol substrate 134 is generally more compressible than the aerosol collection region 136 and deforms around the gripping elements 122. As the substrate carrier 132 is further inserted, the user feels a resistance of the aerosol collection region 136 abutting the gripping elements 122. The slop of the upper surface of the gripping elements 122 helps guide the insertion, while providing a tangible resistance to the user. The user can continue inserting the substrate carrier 132 until the aerosol collection region 136 abuts the upper edge of the thermal engagement elements 120 at which point the user feels a second resistance. This informs the user that the substrate carrier 132 is fully inserted without pushing too hard against the base 112 or the platform 118, which can help prevent damage.

The gripping elements 122 are generally the same shape as one another as this can help provide uniform gripping and centring of the substrate carrier 132 within the heating chamber 108. However, it will be appreciated that different shaped gripping elements 122 may be provided, and that different shaped individual gripping elements 122 may be used in the same heating chamber 108. Additionally, the gripping elements 122 may be generally the same size as each other. For example, each gripping element 122 may have the same length and/or width and/or depth.

In this example, there is the same number of gripping elements 122 as the number of thermal engagement elements 120 (i.e. four). In other examples, there may be a different number of gripping elements 122 to the number of thermal engagement elements 120.

In some examples, the gripping elements 122 may be provided with any of the features mentioned above in relation to the thermal engagement elements 120. In particular, as the gripping elements 122 may be deformed from the side wall 114 in the same way as the thermal engagement elements 120, similar shapes may be provided, although as mentioned it is preferable to have different sizes due to the different functionality. As a further example, the upper edge of the gripping elements 122 may be used to guide insertion of the substrate carrier 132 in the same way as described above in relation to the thermal engagement elements 120.

The gripping elements 122 are formed from a portion of the side wall 114. In other words, the gripping elements 122 are integral with the side wall 114 of the heating chamber 108. In this example, the gripping elements 122 are formed from a deformed portion of the side wall 114. For example, the gripping elements 122 may be embossed from the side wall 114. The gripping elements 122 are indentations formed by deforming part of the side wall 114 into the interior volume of the heating chamber 108. Thus, the gripping elements are preferably not formed by an additional element attached to the side wall 114. Therefore, unnecessary thickness is not added to the side wall 114. This provides the desired function of the gripping elements 122 without increasing the thermal mass of the heating chamber 108. If the thermal engagement elements 120 are also deformed in the same way, this process can be carried out in the same step or in adjacent steps.

Turning to FIG. 8, the arrangement of the gripping elements 122 relative to the substrate carrier 132 is shown in more detail. In this example, the gripping elements 122 are configured to align with a portion of the substrate carrier 132 which does not contain aerosol substrate 134. In particular, the gripping elements 122 align with the aerosol collection region 136 when the substrate carrier 132 is inserted. The aerosol collection region 136 is typically a hollow tube made from a material such as cardboard or acetate. The aerosol collection region 136 provides a region to allow the aerosol to gather once it is released from the aerosol substrate 134, and to allow the vapours to cool and mix with air before being inhaled by a user. The aerosol collection region 136 is typically less compressible than the aerosol substrate 134 and therefore the gripping elements 122 can provide a greater gripping force than against the aerosol substrate 134.

Furthermore, as the aerosol collection region 136 does not shrink during heating, the gripping elements 122 can maintain the grip even after heating.

Figure 9:
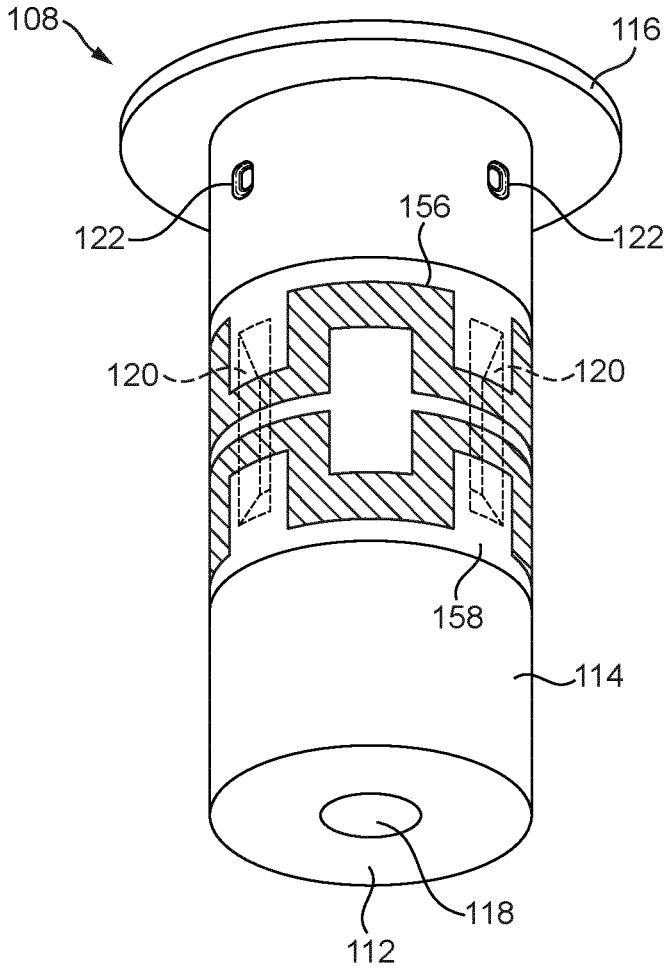
FIG. 9 is a perspective view of the heating chamber of FIG. 5B, shown with a heat generator attached to an external surface of the heating chamber.

Referring to FIG. 9, the heating chamber 108 is shown with a heat generator 130 wrapped around. In this example, the heat generator 130 is an electrical heat generator. The heat generator 130 is in the form of an electrically insulating backing layer 154, for example a polyimide film, with an electrically conductive heating element 156, such as a copper track. The material of the heating element 156 can be chosen to have a desired resistance and thus a desired power output. As used herein, the "heat generator" e.g. heat generator 130 refers to the entire heating component (the heating element 156 and the backing layer 154), while the "heat generator" refers to the heating track or heating element 156. As described above, the heat generator 130 is arranged to overlap a central portion of the side wall 114 and does not overlap at the end towards the open end 110 and the end towards the base 112. In particular, the heat generator 130 is arranged to overlap with the entire length of the thermal engagement elements 120. This provides heat directly to the side wall 114 of the heating chamber 108 in the vicinity of the thermal engagement elements 120. Thus, the thermal engagement elements 120 can conduct heat to the aerosol substrate 132 effectively.

The heat generator 130 is not arranged to overlap with the gripping elements 122. In other words, the heat generator 130 is not arranged over a location of the side wall 114 at which the gripping elements 122 are arranged. That is, there is a gap along the length of the side wall 114 between the location of the gripping elements 122 and the location where the heat generator 130 is arranged. Therefore, the gripping elements 122 are not in contact with the heat generator 130. As mentioned above, this ensures that heat is directed to the thermal engagement elements 120 to conduct heat to the aerosol substrate 134, and prevents heating of the gripping elements 120 to improve heating efficiency.

As mentioned above, optionally there may be a metallic layer present between the external surface of the side wall 114 and the heat generator 130. For example, this may be an electroplated layer of high thermal conductivity metal such as copper for improving thermal transmission efficiency.

In some examples, the backing layer 154 may extend over a larger area than the heating element 156. For example, the heat generator 130 may be arranged along the side wall such that the heating element 156 substantially covers the length of the thermal engagement elements 120, but the backing layer 154 extends further and may in fact overlap with the gripping elements 122. This will not provide a substantial heating effect of the gripping elements 122, and should not be considered as a scenario where the heat generator 130 overlaps with the gripping elements 122. In other words, when the heat generator 130 is arranged to not overlap with the gripping elements 122, this means that the heating element 156 are spaced away from the gripping elements 122, but in some cases the backing layer 154 of the heat generator 130 may overlap the gripping elements 122. Functionally, it is desirable that the gripping elements 122 are not heated by the heat generator 130 to improve heating efficiency.

In alternative examples, the heat generator 130 may at least partially overlap the gripping elements 122. For example, the heat generator element 156 may cover the gripping elements 122. This may be beneficial in some circumstances as this may provide a heating effect through the gripping elements 122 to the aerosol collection region 136. This heat transfer may prevent condensation of the aerosol in the aerosol collection region 136. In some examples, it can be useful not only to heat regions of the substrate carrier 132 which contain aerosol substrate 134, but also other regions. This is because once aerosol is generated, it is beneficial to keep its temperature high (higher than room temperature, but not so high as to burn a user) to prevent re-condensation, which would in turn detract from the user's experience.

Turning to FIG. 8, when a substrate carrier 132 is inserted into the heating chamber 108, the substrate carrier 132 will be contacted by the thermal engagement elements 120. The thermal engagement elements 120 primarily provide thermal contact between the heating chamber 108 and the substrate carrier 132 and are configured to efficiently conduct heat from the heat generator 130 to the substrate carrier 132. To achieve this, it is preferable for the thermal engagement elements 120 to be substantially aligned with at least part of the aerosol substrate 132 within the substrate carrier 132. For example, referring to FIG. 8, when the substrate carrier 132 is inserted into the heating chamber 108, the portion of the substrate carrier 132 which comprises the aerosol substrate 134 is in contact with the thermal engagement elements 120.

In other examples, a portion of the aerosol substrate 134 at the first end 138 of the substrate carrier 132 adjacent the base 112 may not be aligned with the thermal engagement elements 120 to reduce or inhibit heating of substrate at the first end 138. The substrate carrier 132 is supported at the first end 138 by resting on the platform 118 in the base 112 of the heating chamber 108. As described above, the platform 118 is raised above the base 112 in a central area providing a space around the platform 118 where the substrate carrier 132 is spaced away from the base 112. This reduces direct heating of the first end 138. This also promotes air flow into the first end 138.

In this example, when the substrate carrier 132 is inserted, the boundary between the aerosol substrate 134 and the aerosol collection region 136 is arranged to substantially align with the upper surface of the thermal engagement elements 120. This can provide a seal to retain heat and vapours and prevent heating of the aerosol collection region 106 where aerosol is not produced.

When the substrate carrier 132 is inserted into the heating chamber 108, the gripping elements 122 are configured to contact the substrate carrier 132 at a point between the aerosol substrate 134 and the second end 140. In other words, the gripping elements 122 are positioned to contact the substrate carrier 132 at a position not overlapping the aerosol substrate 134. In this example, the gripping elements 122 are arranged to contact the substrate carrier 132 at the aerosol collection region 136. In this way, the gripping elements 122 can grip the aerosol substrate 134 at a position that will not interfere with the heating of the aerosol substrate 134. Furthermore, as the aerosol substrate 134 is heated, it begins to shrink and reduce contact with the thermal engagement elements 120. This does not have a significant effect on the ability of the thermal engagement elements 120 to heat the aerosol substrate 134, and heat via convection is in any case unimpeded, but it may lead to a less secure engagement between the thermal engagement elements 120 and the aerosol substrate 134 as the aerosol substrate 134 shrinks away from the thermal engagement elements 120. Thus, by providing gripping elements 122 at a location away from the aerosol substrate 134, the substrate carrier 132 can be secured in place irrespective of any shrinkage of the aerosol substrate 134 during heating.

It will therefore be realised that there is provided a heating chamber 108 for an aerosol generation device 100, the heating chamber 108 comprising: an open first end 110 through which a substrate carrier 132 including aerosol substrate 134 is insertable in a direction along a length of the heating chamber 108; a side wall 114 defining an interior volume of the heating chamber 108; a plurality of thermal engagement elements 120 for contacting and providing heat to the substrate carrier 132, each thermal engagement element 120 extending inwardly from an interior surface of the side wall 114 into the interior volume at a different location around the side wall 114; and a plurality of gripping elements 122, spaced apart from the thermal engagement elements 120 along a length of the side wall 114, each gripping element 122 extending inwardly from the interior surface of the side wall 114 into the interior volume at a different location around the side wall 114; wherein the gripping elements 122 are located closer to the open first end 110 than the thermal engagement elements 120 are.

Figure 11:
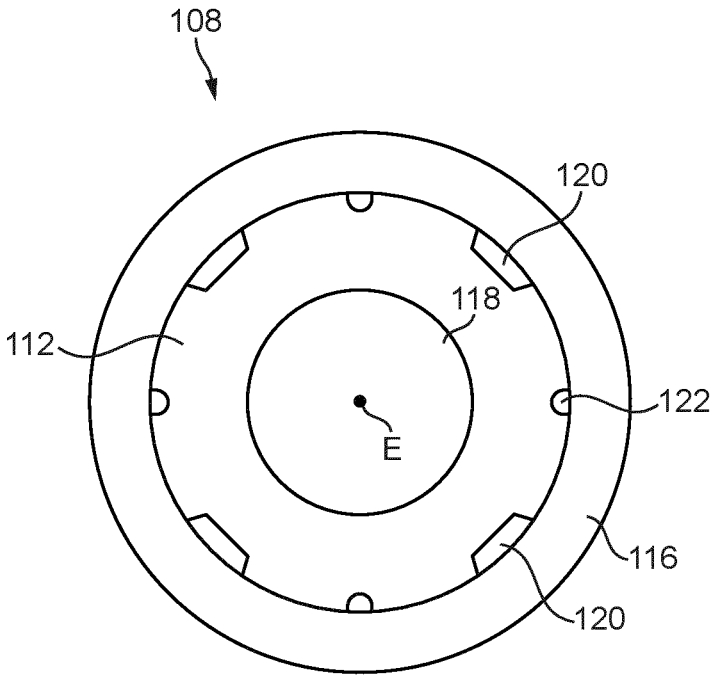
FIG. 11 is a schematic plan view from above of the heating chamber of FIG. 10.

Referring to FIGS. 10 and 11, another example of a heating chamber 108 is shown, where the gripping elements 122 are not aligned with the thermal engagement elements 120 along the length of the side wall 114. It will be apparent that arranging the orientation of the gripping elements 122 and the thermal engagement elements 120 in this way nonetheless leads to a well-functioning device 100.

Referring to FIG. 12, a further example of a heating chamber 108 is shown in a sectional view through the gripping elements 122. Here, the gripping elements 122 are shown to have a triangular profile in a plane perpendicular to the length of the side wall 114. This profile may be particularly adapted to gripping the substrate carrier 132 to prevent relative movement between the substrate carrier 132 and the device 100. The gripping elements 122 shown here are formed from a deformation of the side wall 114, and consequently have the same thickness as the side wall 114.

The invention claimed is:

1. A heating chamber for an aerosol generation device, the heating chamber comprising:

an open first end through which a substrate carrier including aerosol substrate is insertable in a direction along a length of the heating chamber;

a side wall defining an interior volume of the heating chamber;

a plurality of thermal engagement elements for contacting and providing heat to the substrate carrier, each of the plurality of thermal engagement elements extending inwardly from an interior surface of the side wall into the interior volume at a different location around the side wall; and a plurality of gripping elements, spaced apart from the plurality of thermal engagement elements along a length of the side wall, each of the plurality of gripping elements extending inwardly from the interior surface of the side wall into the interior volume at a different location around the side wall; wherein the plurality of gripping elements are located closer to the open first end than the thermal engagement elements.

2. The heating chamber according to claim 1, wherein the plurality of thermal engagement elements comprise a deformed portion of the side wall.

3. The heating chamber according to claim 1, wherein the side wall has a substantially constant thickness.

4. The heating chamber according to claim 3, wherein the substantially constant thickness is lower than 1.2 mm.

5. The heating chamber according to claim 1, wherein the side wall is formed of metal.

6. The heating chamber according to claim 1, wherein the plurality of thermal engagement elements comprise an embossed portion of the side wall.

7. The heating chamber according to claim 1, wherein the heating chamber has a central axis along which the substrate carrier is insertable; wherein the plurality of gripping elements each have an innermost portion for gripping the substrate carrier located a first radial distance from the central axis; and the plurality of thermal engagement elements each have an innermost portion for contacting the substrate carrier located a second radial distance from the central axis; the first radial distance being larger than the second radial distance.

8. The heating chamber according to claim 7, wherein the first radial distance is at least 0.05 mm larger than the second radial distance.

9. The heating chamber according to claim 7, wherein the first radial distance is between 0.1 and 0.5 mm larger than the second radial distance.

10. The heating chamber according to claim 1, wherein the plurality of thermal engagement elements and the plurality of gripping elements are formed as a single integral part of the side wall.

11. The heating chamber according to claim 1, wherein the plurality of thermal engagement elements have a different profile in a plane parallel to the length of the heating chamber from a profile of the plurality of gripping elements in a plane parallel to the length of the heating chamber.

12. The heating chamber according to claim 1, wherein the plurality of thermal engagement elements have the same shape as one another.

13. The heating chamber according to claim 1, wherein the plurality of gripping elements have the same shape as one another.

14. The heating chamber according to claim 1, wherein a total number of the plurality of thermal engagement elements is the same as a total number of the plurality of gripping elements.

15. The heating chamber according to claim 1, wherein the plurality of thermal engagement elements extend a first distance along the length of the side wall and the plurality of gripping elements extend a second distance along the length of the side wall, wherein the first distance is greater than the second distance.

16. The heating chamber according to claim 1, wherein at least one of the plurality of gripping elements has a pointed or rounded profile projecting inwardly into the interior volume.

17. The heating chamber according to claim 1, further comprising a heat generator arranged to provide heat to the substrate carrier.

18. The heating chamber according to claim 17, wherein the heat generator is located so as to extend a fifth distance along the side wall such that at least part of the heat generator is located adjacent to at least part of a portion of the side wall corresponding to a location of the plurality of thermal engagement elements.

19. The heating chamber according to claim 18, wherein the heat generator is located such that the heat generator is not located adjacent to any part of a portion of the side wall corresponding to a location of the plurality of gripping elements.

20. The heating chamber according to claim 1, further comprising a bottom at a second end of the side wall, opposite the open first end.

21. The heating chamber according to claim 1, further comprising a substrate carrier, the substrate carrier having a first portion and a second portion, wherein the first portion is positioned further from the open first end than the second portion when the substrate carrier is inserted into the heating chamber, and wherein the first portion includes an aerosol substrate.

22. The heating chamber according to claim 21, wherein the plurality of thermal engagement elements are arranged to contact the first portion of the substrate carrier.

23. The heating chamber according to claim 21, wherein the plurality of gripping elements are arranged to grip the second portion of the substrate carrier.

24. The heating chamber according to claim 21, wherein the second portion does not contain aerosol substrate.

25. An aerosol generation device comprising:

an electrical power source;

the heating chamber according to claim 1;

a heat generator arranged to supply heat to the heating chamber;

control circuitry configured to control a supply of electrical power from the electrical power source to the heat generator; and an outer housing enclosing the electrical power source, the heating chamber, the heat generator, and the control circuitry, wherein the outer housing has an aperture formed therein for accessing the interior volume of the heating chamber.

26. The heating chamber according to claim 1, wherein at least one of the plurality of gripping elements has a pointed profile projecting inwardly into the interior volume, wherein the pointed profile is triangular.

27. The heating chamber according to claim 1, wherein at least one of the plurality of gripping elements has a rounded profile projecting inwardly into the interior volume, wherein the rounded profile is a portion of a sphere.

* * * * *